US006679092B2

(12) United States Patent
Irii

(10) Patent No.: US 6,679,092 B2
(45) Date of Patent: Jan. 20, 2004

(54) AUTOMOBILE SHEET METAL SURFACE CORRECTING EQUIPMENT

(75) Inventor: Kiyotaka Irii, Saitama-ken (JP)

(73) Assignee: Star Co., Ltd., Gunma-ken (JP)

( * ) Notice: Subject to any disclaimer, the term of this patent is extended or adjusted under 35 U.S.C. 154(b) by 0 days.

(21) Appl. No.: 10/057,044

(22) Filed: Jan. 25, 2002

(65) Prior Publication Data

US 2002/0104365 A1 Aug. 8, 2002

(30) Foreign Application Priority Data

Feb. 4, 2001 (JP) ..... 2001-069453

(51) Int. Cl.[7] ..... B21J 13/08
(52) U.S. Cl. ..... 72/457; 72/453.01; 72/705
(58) Field of Search ..... 72/392, 407, 408, 72/447, 453.01, 453.02, 453.03, 453.06, 456.07, 457, 458, 705; 29/238, 239; 254/93 R

(56) References Cited

U.S. PATENT DOCUMENTS

| | | | | |
|---|---|---|---|---|
| 2,863,489 A | | 12/1958 | Priest | 153/38 |
| 3,395,561 A | * | 8/1968 | Lague et al. | 72/308 |
| 3,545,250 A | | 12/1970 | Jones | 72/705 |
| 3,662,994 A | * | 5/1972 | Johns | 254/93 R |
| 3,869,767 A | | 3/1975 | Hunnicutt et al. | 24/243 CC |
| 3,891,187 A | * | 6/1975 | Beardon, Jr. | 254/93 R |
| 3,922,902 A | * | 12/1975 | Jarman | 72/705 |
| 4,495,789 A | * | 1/1985 | Ivanov | 72/302 |
| 4,495,791 A | | 1/1985 | Kemnitz et al. | 72/453.02 |
| 4,783,053 A | * | 11/1988 | Yirmiyahu et al. | 254/93 R |
| 4,914,942 A | | 4/1990 | Ishihara | 72/463 |
| 4,930,335 A | | 6/1990 | Ishihara | 72/451 |
| 5,333,486 A | | 8/1994 | Ishihara | 72/391.2 |
| 5,431,039 A | * | 7/1995 | Goodman et al. | 72/447 |
| 5,943,902 A | | 8/1999 | Ishihara | 72/451 |

FOREIGN PATENT DOCUMENTS

| | | |
|---|---|---|
| DE | 3241902 | 1/1984 |
| DE | 9315560 | 2/1994 |
| EP | 0375630 | 6/1990 |

* cited by examiner

*Primary Examiner*—Ed Tolan
(74) *Attorney, Agent, or Firm*—Steinberg & Raskin, P.C.

(57) ABSTRACT

An automobile sheet metal surface correcting equipment capable of permitting alignment between a piston of the equipment and a portion of the sheet metal surface to be corrected to be carried out from an inside of the sheet metal such as a bonnet, to thereby facilitate sheet metal working. The equipment includes a housing having an air flow path switchably arranged therein, an air introduction structure provided therein with air introduction passages for introducing compressed air into the housing therethrough, an impact wrench mechanism arranged in the housing and actuated by compressed air fed through the air introduction structure into the housing, a screw bolt having rotating force applied thereto from the impact wrench mechanism, and a piston mechanism including a cylinder and a piston movably arranged in the cylinder in a retractable manner in association with rotation of the screw bolt; so that the air flow path in the housing is changed over to retractably move the piston of the piston mechanism, resulting in correcting a metal sheet surface.

18 Claims, 30 Drawing Sheets

(A)

(B)

AUTOMOBILE SHEET METAL SURFACE CORRECTING EQUIPMENT

BACKGROUND OF THE INVENTION

This invention relates to an equipment for correcting a surface of a sheet metal material for an automobile or an automobile sheet metal surface correcting equipment adapted to push or pull a surface of a sheet metal material to correct roughness or ruggedness of the surface such as deformation thereof, strain thereof or the like, and more particularly to an automobile sheet metal surface correcting equipment which is adapted to actuate an impact wrench mechanism by means of compressed air fed from an air supply means such as, for example, an air compressor or the like thereto to retractably operate a piston arranged in a cylinder thereof, to thereby correct ruggedness of the automobile sheet metal surface.

An equipment which has been conventionally used for repairing roughness or ruggedness generated on a surface of a sheet metal material of an automobile due to a traffic accident or the like is constructed in such a manner as shown in either FIGS. 27(A), 27(B) and 29 or FIGS. 28(A), 28(B) and 30. The conventional equipment generally designated at reference numeral 300 in FIGS. 27(A), 27(B) and 29 is constructed in such a manner that a handle 311 of a hydraulic pump 310 connected through a high pressure hose 303 to a cylinder 301 in which a piston 302 is movably received is operated to extend the piston 302 from the cylinder 301, resulting in an inward projection 350 generated on a sheet metal surface of an automobile 200 being pushed out through an attachment 155 attached to a distal end of the piston 302. The conventional equipment generally designated at reference numeral 400 in FIGS. 28(A), 28(B) and 30 is so constructed that a handle 311 of a hydraulic pump 310 connected through a high pressure hose 303 to a cylinder 401 having a piston 402 movably received therein is operated to retract the piston 402 into the cylinder 401, resulting in a depression 351 generated on a metal sheet surface of an automobile 200 being forced out.

Unfortunately, the prior art encounters some important disadvantages.

More particularly, in order to smoothly carry out sheet metal working for an automobile, it is required to prepare two kinds of sheet metal surface correcting equipments or such a sheet metal surface correcting equipment as shown in FIGS. 27 and 29 exclusively used for force out a projection on a sheet metal surface of an automobile and that as shown in FIGS. 28 and 30 exclusively used for pulling out a depression on the sheet metal surface. This causes metal sheet operation or working to be highly troublesome and expensive because two such sheet metal surface correcting equipments must be selectively applied depending on properties of the sheet metal surface.

Another disadvantage of the prior art is that there is a likelihood of causing oil to leak from the hydraulic pump during sheet metal working, leading to contamination of the automobile with the oil.

Further, the prior art renders separation of the high pressure hose from the hydraulic pump during pressurization highly difficult, to thereby fail to move or shift the hydraulic pump, so that smooth sheet metal working may not be ensured.

Moreover, the prior art is highly laborious because of requiring two workers or one for positioning the distal end of the piston on a portion of the metal sheet surface to be corrected and the other for carrying out pressurizing operation by means of the hydraulic pump.

SUMMARY OF THE INVENTION

The present invention has been made in view of the foregoing disadvantages of the prior art.

Accordingly, it is an object of the present invention to provide an automobile sheet metal surface correcting equipment which is capable of solely selectively carrying out pushing or pulling of a sheet metal surface depending on properties of the sheet metal surface.

It is another object of the present invention to provide an automobile sheet metal surface correcting equipment which is capable of effectively preventing contamination of an automobile during sheet metal working.

It is a further object of the present invention to provide an automobile sheet metal surface correcting equipment which is capable of permitting an air hose for connecting a compressed air feed means and the sheet metal surface correcting equipment to each other therethrough to be separated from the latter in the course of advancing or retracting of a piston, to thereby facilitate correction of a site or portion of a sheet metal surface to be corrected, even when the portion requires that alignment between the piston and the portion of the surface is carried out from an inside of the metal sheet.

It is still another object of the present invention to provide an automobile sheet metal surface correcting equipment which is capable of permitting only one worker to rapidly carry out both operation of positioning a distal end of a piston on a portion of a sheet metal surface to be corrected and operation of advancing or retracting the piston, resulting in facilitating sheet metal working.

It is yet another object of the present invention to provide an automobile sheet metal surface correcting equipment which is capable of adequately withstanding a load during sheet metal drawing operation or working which readily causes the load to be applied to a housing of the equipment.

It is a still further object of the present invention to provide an automobile sheet metal surface correcting equipment which is capable of being portable and compact in structure.

In accordance with the present invention, an automobile sheet metal surface correcting equipment is provided. The automobile sheet metal surface correcting equipment includes a housing having an air flow path means switchably arranged therein, an air introduction means provided therein with air introduction passages for introducing compressed air into the housing therethrough, an impact wrench mechanism arranged in the housing and actuated by means of compressed air fed through the air introduction means into the housing, a screw bolt having rotating force applied thereto from the impact wrench mechanism, and a piston mechanism including a cylinder and a piston movably arranged in the cylinder in a retractable manner in association with rotation of the screw bolt, whereby the air flow path means in the housing is changed over to retractably move the piston of the piston mechanism, resulting in a metal sheet surface being corrected.

In a preferred embodiment of the present invention, the impact wrench mechanism includes an air motor actuated by means of compressed air fed to the housing and an impact wrench actuated by the air motor. Also, a rotation direction changing-over valve is arranged for changing over the air flow path means, to thereby change over a direction of rotation of the air motor of the impact wrench mechanism.

The air flow path means includes a first air flow path and a second air flow path which are changed over by the rotation direction changing-over valve. Such construction permits a direction of rotation of the air motor to be changed over to actuate the piston of the piston mechanism, to thereby correct the sheet metal surface.

In a preferred embodiment of the present invention, holding bolts are arranged for mounting a cover means on each of end surfaces of the housing to close the end surface, whereby the air flow path means in the housing is changed over during actuation of the impact wrench mechanism to actuate the piston of the piston mechanism, resulting in correcting the sheet metal surface.

In a preferred embodiment of the present invention, holding bolts are arranged for mounting a cover means on each of end surfaces of the housing to close the end surface, whereby a direction of rotation of the air motor is changed over to actuate the piston of the piston mechanism, to thereby correct the sheet metal surface.

In a preferred embodiment of the present invention, the air introduction means includes a handle having the air introduction passages formed therein. The handle is arranged above the housing.

In a preferred embodiment of the present invention, the housing includes a first receiving portion and a second receiving portion. The first receiving portion has the impact wrench mechanism received therein. The screw bolt includes a bolt head. The second receiving portion has the bolt head of the screw bolt received therein. The housing has a first opening formed on one of the end surfaces thereof and a second opening formed on the other of the end surfaces thereof. The first opening is closed with a first cover means and the second opening is closed with a second cover means.

In a preferred embodiment of the present invention, the first cover means is formed on an inner surface thereof with a pair of air passages constituting a part of the air flow path means.

In a preferred embodiment of the present invention, the housing has a cylindrical hole formed above the first receiving portion to fit a bushing therein, wherein the bushing is formed at a lower portion thereof on a rear right side thereof with a first air outlet hole and at a lower portion thereof on a front left side thereof with a second air outlet hole. The housing has two air passages formed on both sides of the cylindrical hole. One of the air passages is arranged so as to communicate with one air passage of the first cover means and the first air outlet hole of the bushing, and the other of the air passage is arranged so as to communicate with the other air passage of the first cover means and the second air outlet hole of the bushing.

In a preferred embodiment of the present invention, the housing has a step formed on an upper surface thereof and the air introduction means includes a handle formed with the air introduction passage. The step of the housing is formed with an air introduction hole so as to communicate with the air introduction passage of the handle.

In a preferred embodiment of the present invention, the step of the housing is formed at corners thereof with threaded holes. The handle is airtightly fixed at a proximal end thereof on the step of the housing by means of bolts.

In a preferred embodiment of the present invention, the air introduction means includes a handle, an air regulator arranged on a proximal end of the handle, an air valve arranged on a central portion of a bottom surface of the handle, a switch lever disposed so as to operate the air valve, a control pin for selectively controlling movement of the switch lever, and a stopper pivotally supported in a cutout formed at a free end of the switch lever so as to be raised therein. The air valve is rendered open by operating the switch lever toward the bottom surface of the handle. Control of movement of the switch lever by the control pin is carried out in order to maintain such an open state of the air valve.

In a preferred embodiment of the present invention, the air valve includes a valve body. The valve body is disposed in a valve chest arranged between the air introduction passages. The valve body of the air valve, when the switch lever is operated to upwardly push a lower end of the air valve while abuttedly contacting it with an upper surface of the switch lever, is raised from a valve seat arranged in the valve chest, resulting in the air valve being rendered open, so that the air introduction passages may be permitted to communicate with each other, to thereby permit compressed air introduced to flow into the housing through the air introduction hole formed on the upper surface of the housing.

In a preferred embodiment of the present invention, the rotation direction changing-over valve is projected at both ends thereof from the bushing.

In a preferred embodiment of the present invention, the piston mechanism includes the piston, the cylinder and a piston guide member. The piston is constructed into a hollow structure, resulting in being provided therein with a central hole so as to extend in a longitudinal direction thereof. The central hole of the piston is formed with female threads with which male threads of the screw bolt are threadedly engaged. The piston is formed on an outer peripheral surface thereof with an elongated guide groove for guiding the piston guide member and the guide groove is arranged so as to extend in the longitudinal direction of the piston.

In a preferred embodiment of the present invention, the first cover means, housing and second cover means are integrally connected to each other by means of the holding bolts inserted through corners of the housing. The holding bolts each are threadedly engaged at a distal end thereof with each of the female screws formed in the second cover member.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1:
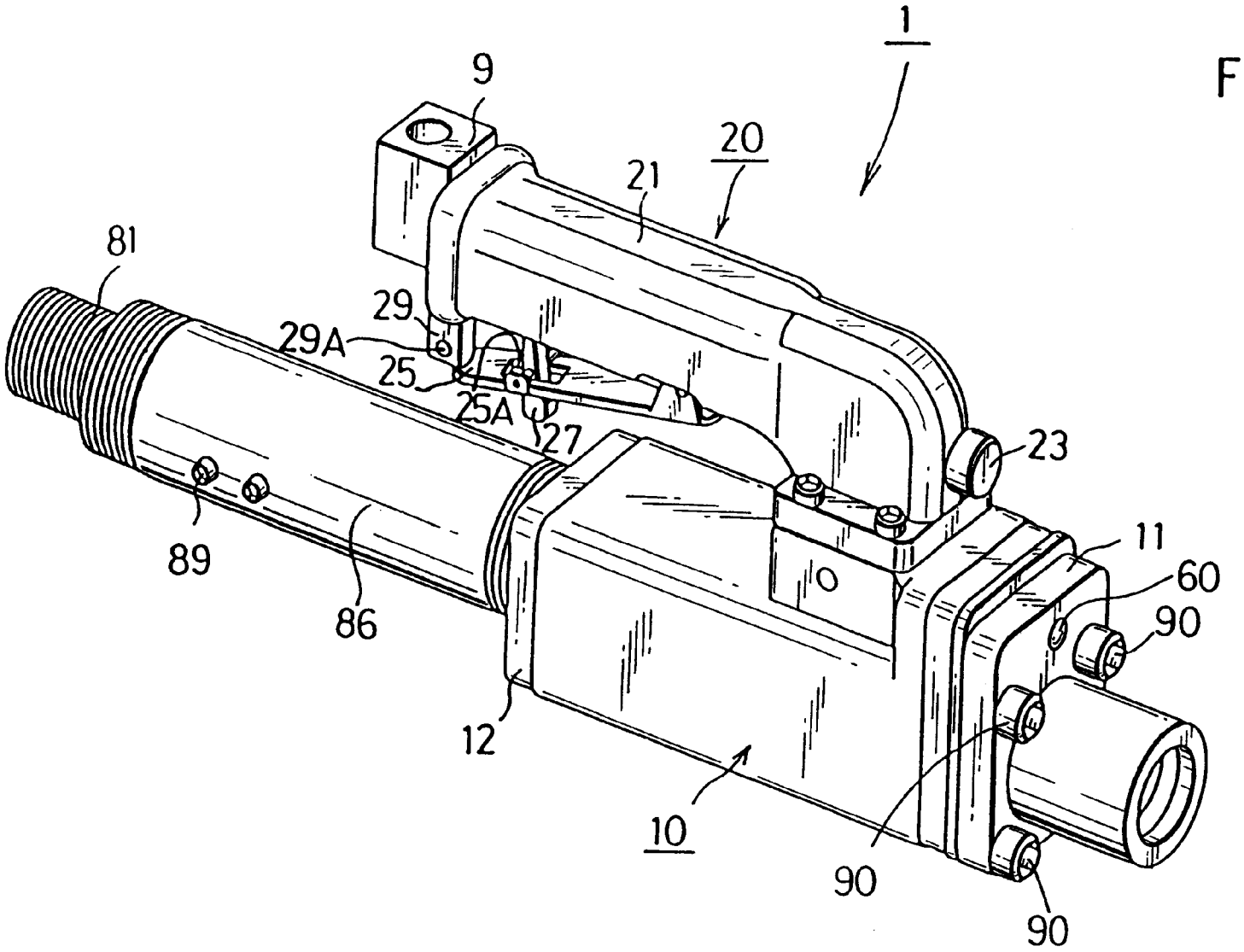
FIG. 1 is a perspective view showing an embodiment of an automobile sheet metal surface correcting equipment according to the present invention.

Now, an automobile sheet metal surface correcting equipment according to the present invention will be described with reference to FIGS. 1 to 26, which illustrate an embodiment of an automobile sheet metal surface correcting equipment according to the present invention.

An automobile sheet metal surface correcting equipment of the illustrated which is generally designated at reference numeral 1 includes a housing 10, an air introduction means 20 which is provided therein with air introduction passages for introducing compressed air into the housing 10 therethrough, an impact wrench mechanism 30 arranged in the housing 10 and actuated by means of compressed air fed through the air introduction means 20 into the housing 10, a rotation direction changing-over valve 60 for changing over a direction of rotation of an air motor constituting the impact wrench mechanism 30, a screw bolt 70 having revolving force applied thereto from the impact wrench mechanism 30, a piston mechanism 80 including a cylinder 86 and a piston 81 movably arranged in the cylinder 86 so as to be retractable with respect to the cylinder 86, and holding bolts 90 inserted through corners of the housing 10 to mount first and second cover means 11 and 12 for covering or closing openings 10A and 10B formed on both end surfaces of the housing 10 on the housing 10.

The housing 10 is formed therein with two air passages or first and second air passages, which are changed over by the rotation direction changing-over valve 60 to retractably move the piston 81 of the piston mechanism 81, to thereby selectively push or pull a sheet metal surface, leading to correction of the sheet metal surface.

Figure 10:
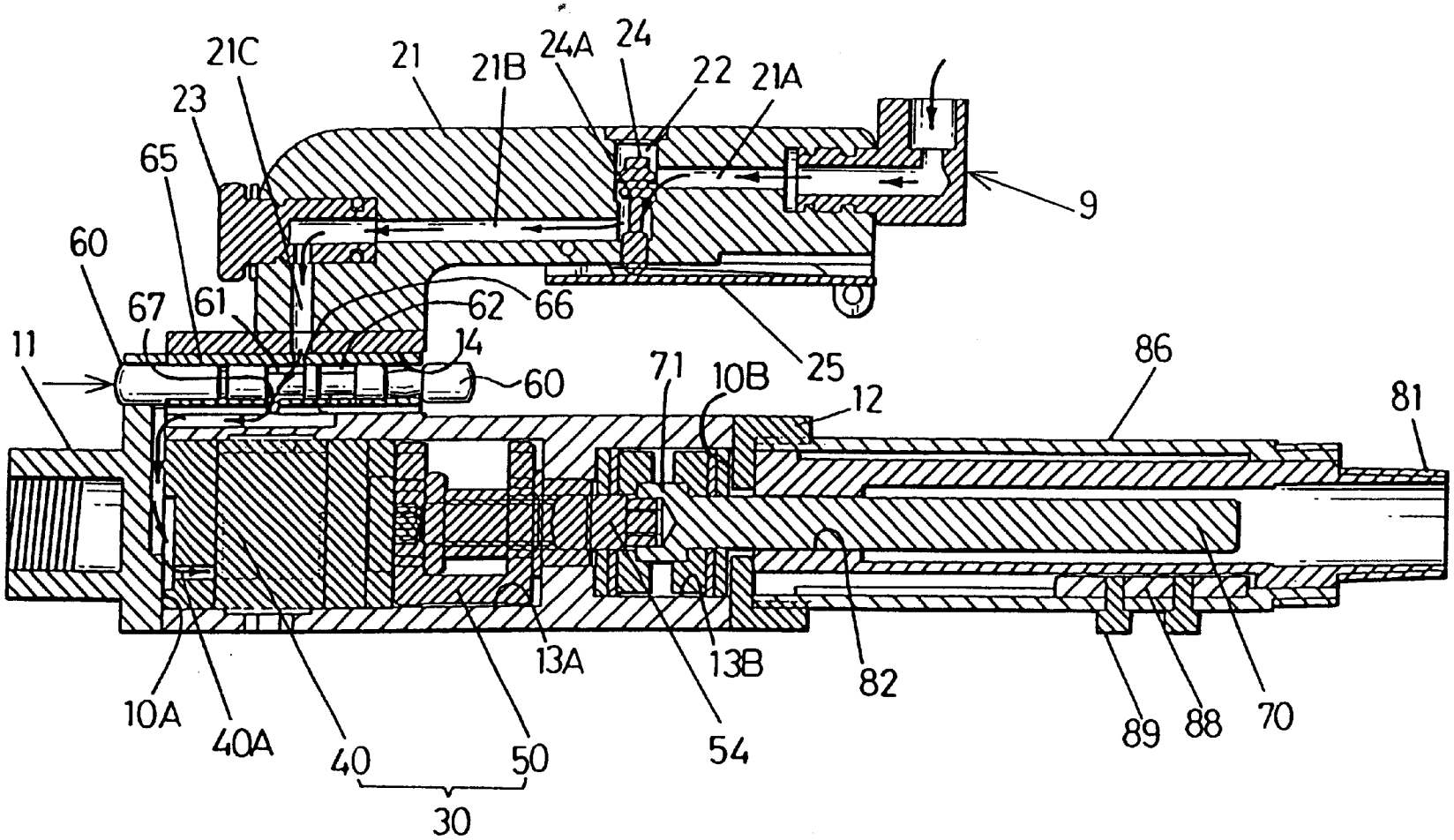
FIG. 10 is a sectional view taken along line X—X of FIG. 5, which shows flow of compressed air obtained when an air motor is rotated normally or in a counter-clockwise direction to advance a piston from an interior of a cylinder.
Figure 11:
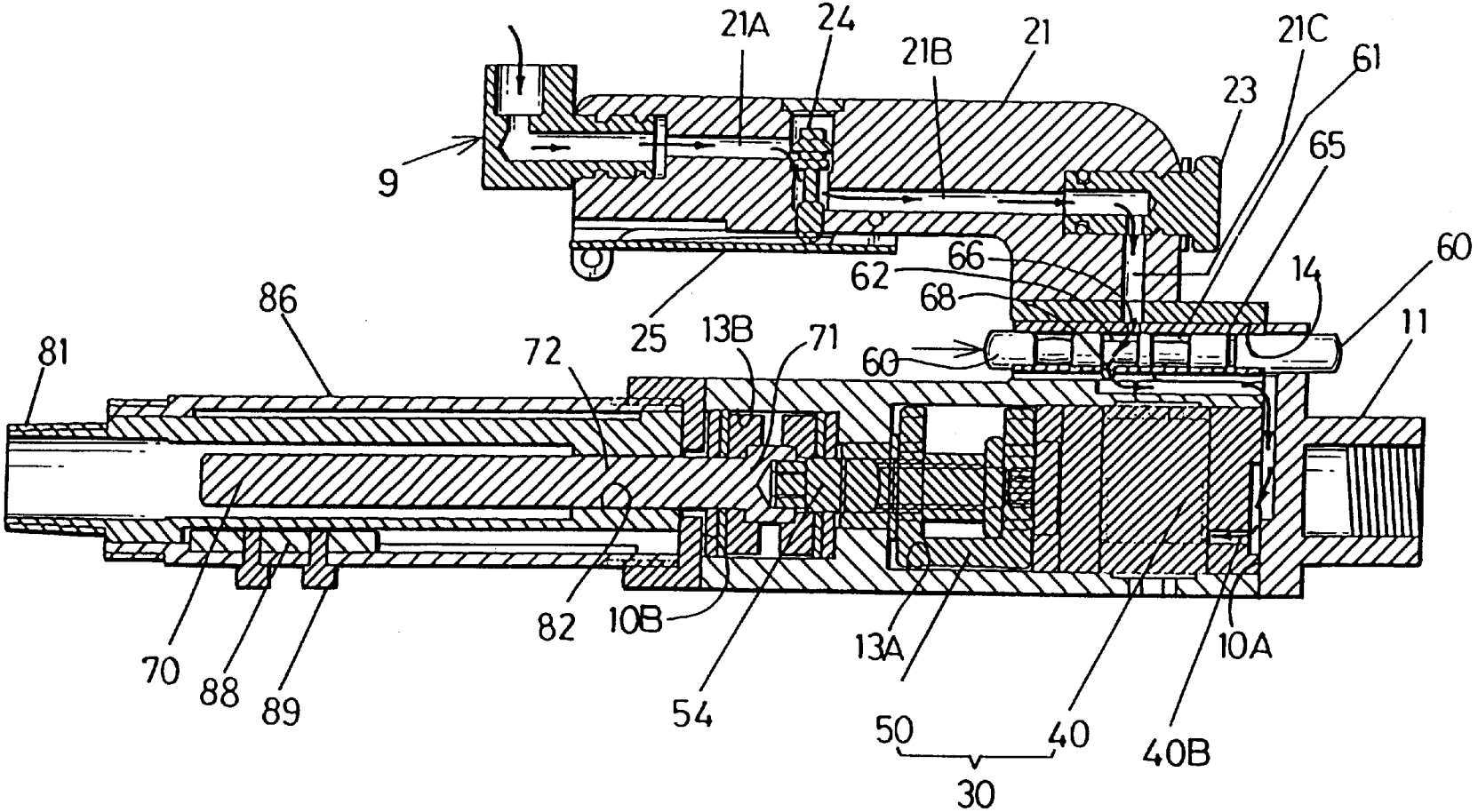
FIG. 11 is a sectional view taken along line Y—Y of FIG. 6, which shows flow of compressed air obtained when an air motor is rotated reversely or in a clockwise direction to retract a piston into a cylinder.
Figure 17:
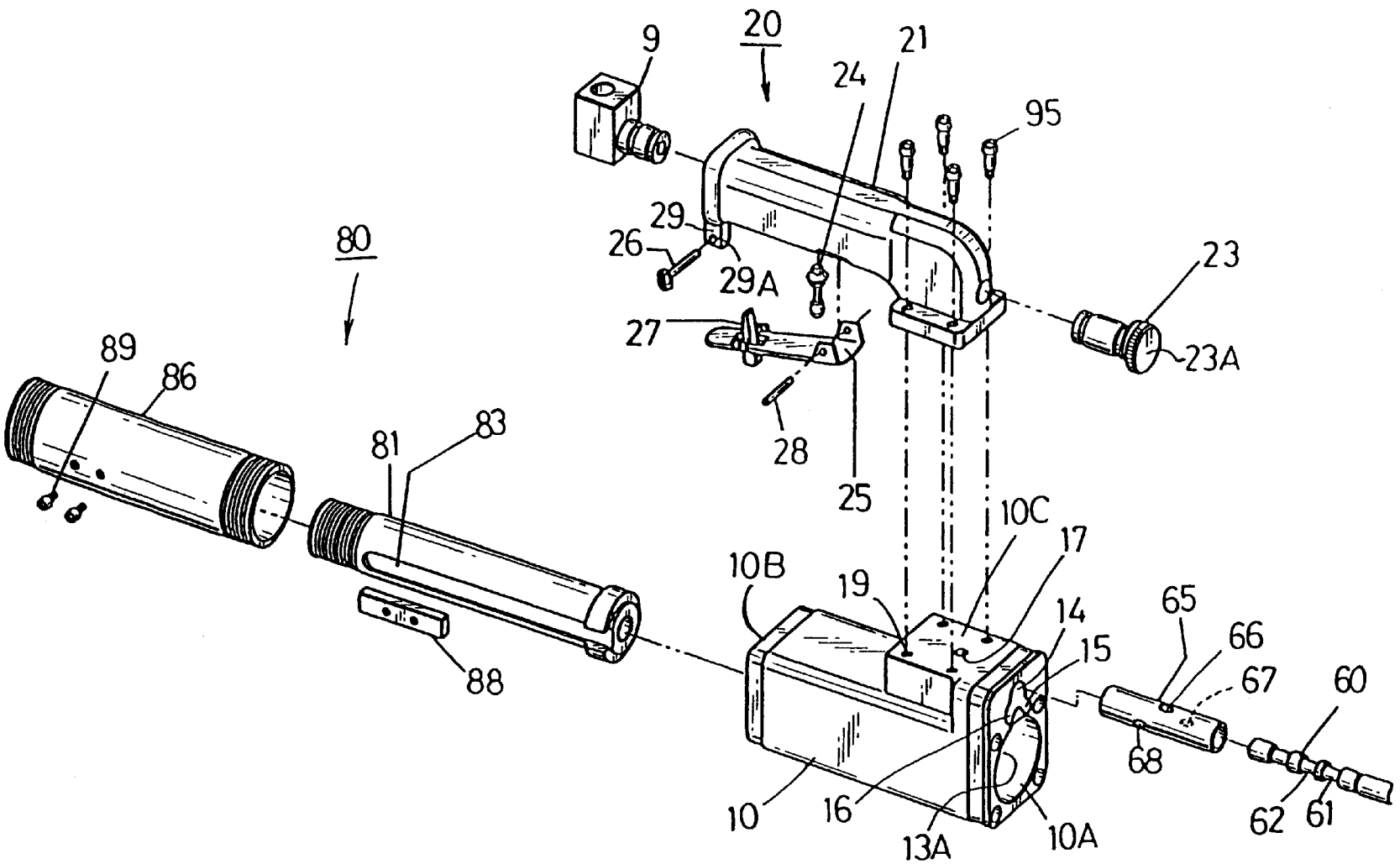
FIG. 17 is an exploded perspective view showing components of each of a housing, an air suction means, a piston mechanism and a rotation direction changing-over valve incorporated in the automobile sheet metal surface correcting equipment of FIG. 1.

The housing 10 is formed in a rear half thereof with a first receiving portion 13A of a large diameter and in a front half thereof with a second receiving portion 13B of a small diameter, as shown in FIGS. 10, 11 and 17.

Figure 16:
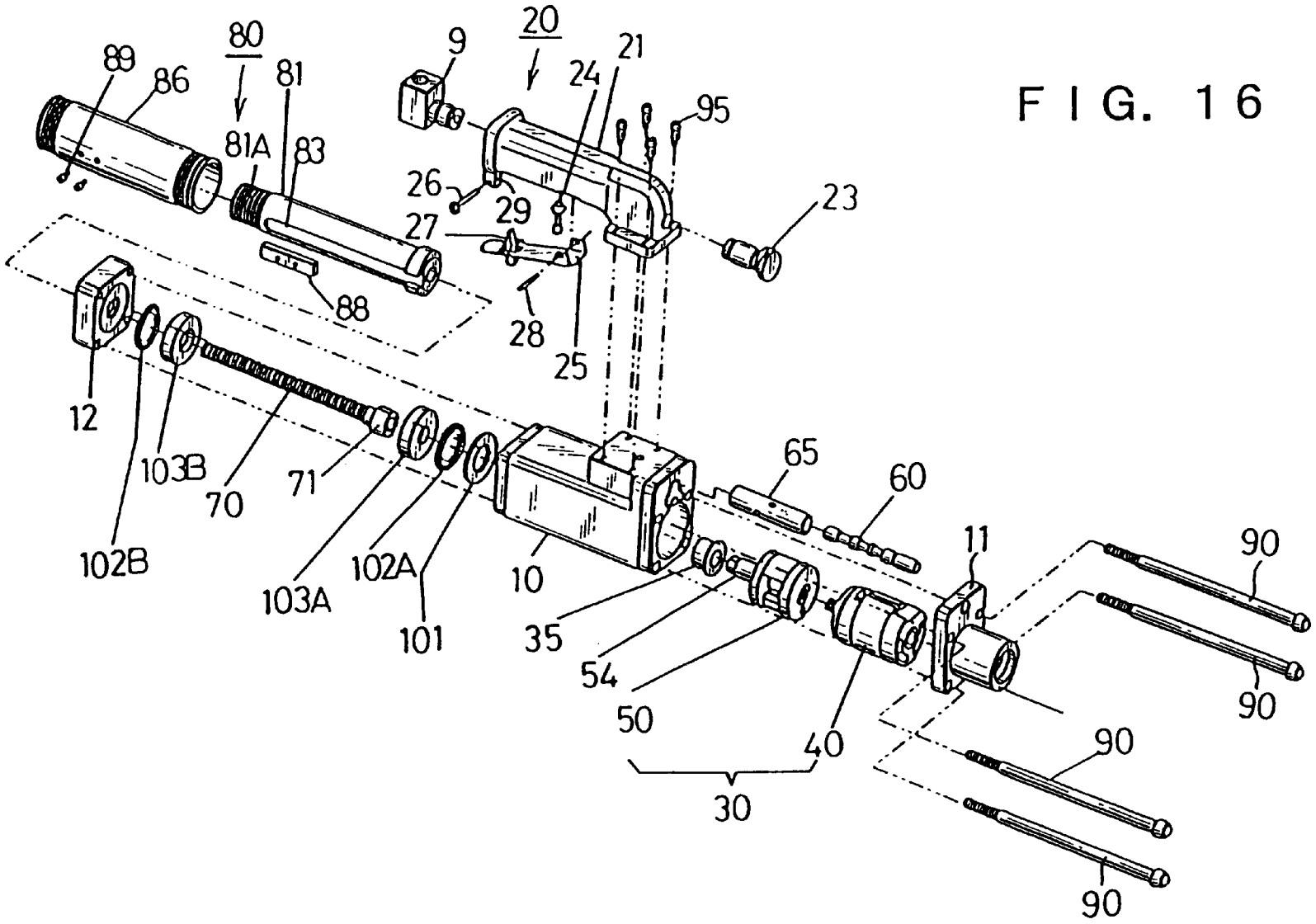
FIG. 16 is an exploded perspective view showing components of the automobile sheet metal surface correcting equipment of FIG. 1.

The first receiving portion 13A of the housing 10 has the impact wrench mechanism 30 and a guide member 35 received therein and the opening 10A formed on one of the end surfaces of the housing 10 is covered with a cap which acts as the first cover means 11, as shown in FIG. 16. The second receiving portion 13B of the housing 10 has a bolt head 71 of the screw bolt 70, a spacer 101, thrust bearings 102A and 102B for ensuring smooth rotation of the screw bolt 70, and bolt receivers 103A and 103B received therein. The opening 10B formed on the other end surface of the housing 10 is covered with a cover acting as the second cover means 12, as shown in FIG. 16.

Figure 5:
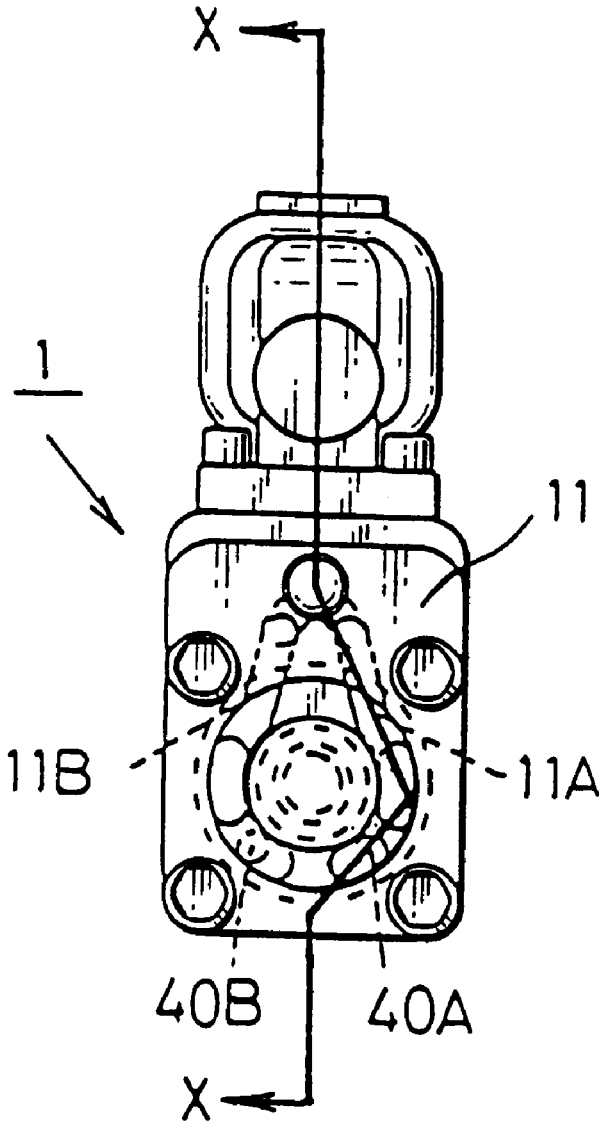
FIG. 5 is a schematic right side elevation view of the automobile sheet metal surface correcting equipment shown in FIG. 1 in which a switch lever is kept raised and a rotational direction changing-over valve is kept forwardly forced out.
Figure 6:
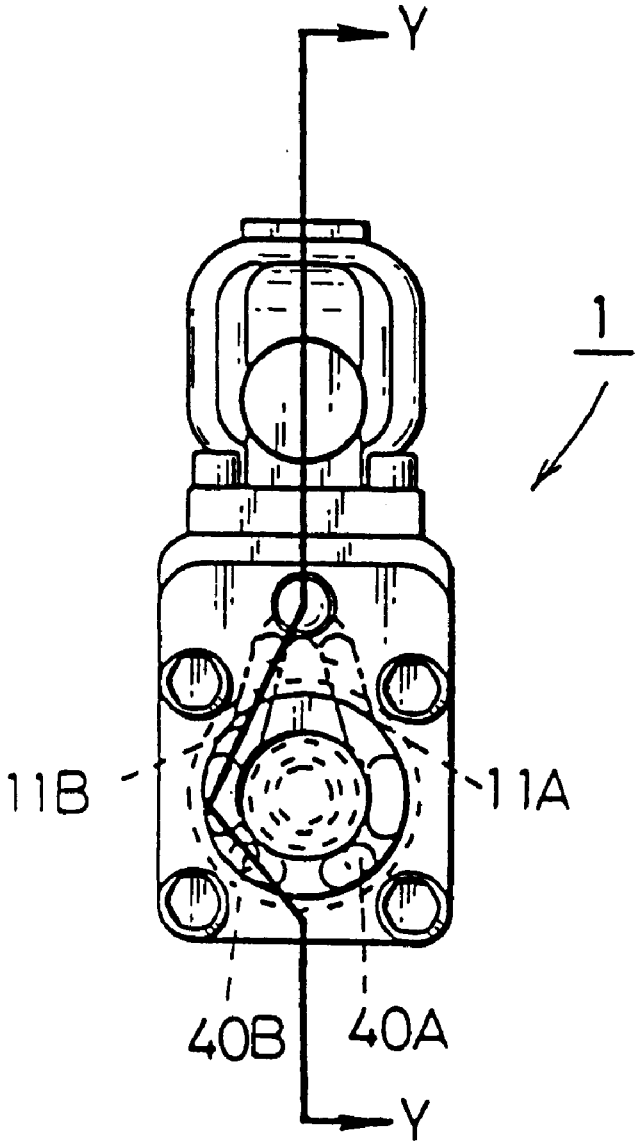
FIG. 6 is a schematic right side elevation view of the automobile sheet metal surface correcting equipment shown in FIG. 1 in which a switch lever is kept raised and a rotational direction changing-over valve is kept forced out rearwardly of a position thereof shown in FIG. 5.
Figure 7:
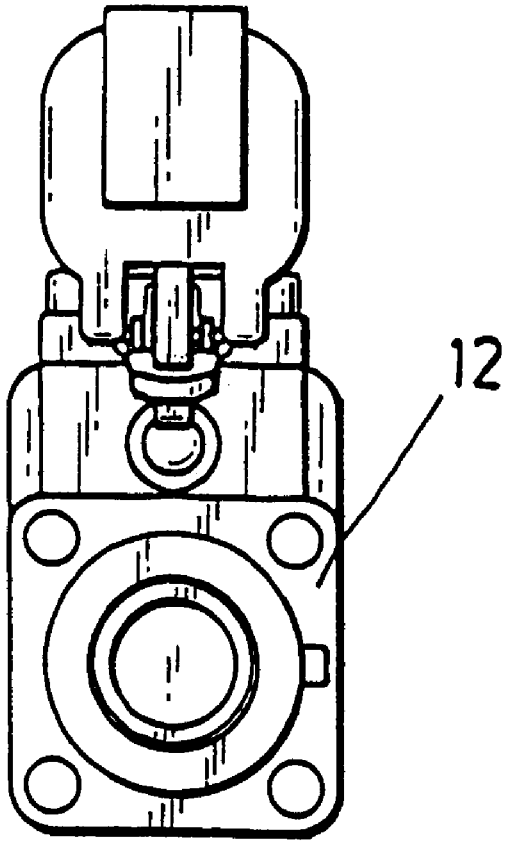
FIG. 7 is a left side elevation view of the automobile sheet metal surface correcting equipment shown in FIG. 1.
Figure 8:
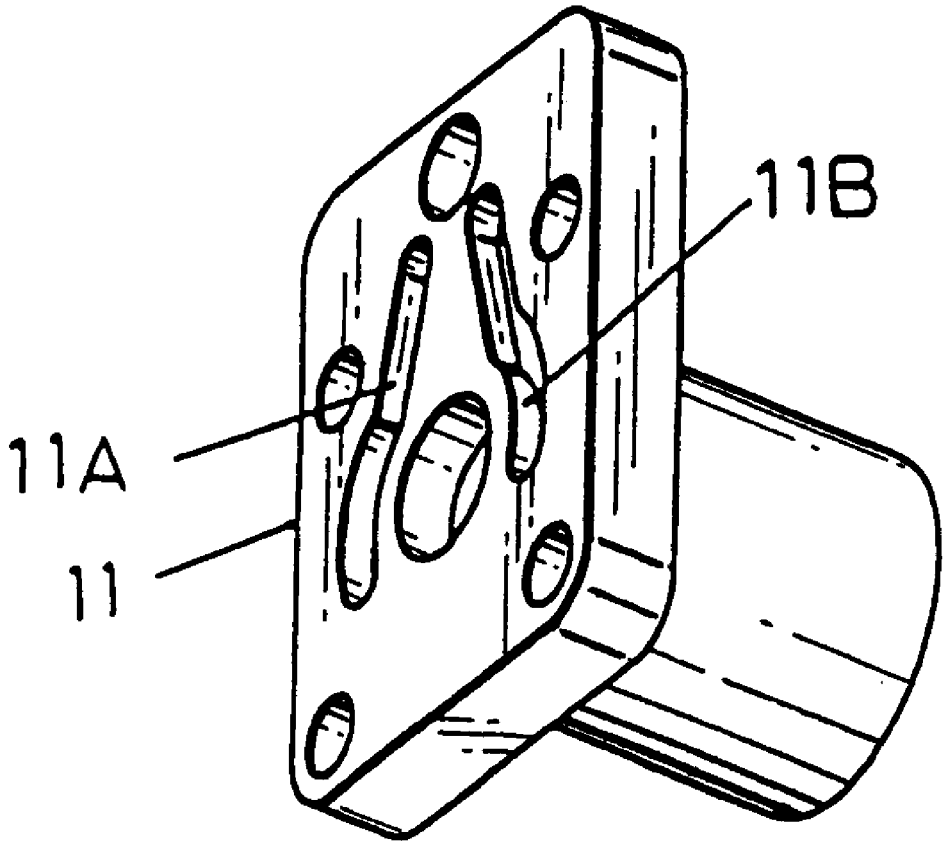
FIG. 8 is a perspective view showing a cap which serves as a first cover means for covering or closing an opening formed on a rear end surface of a housing of the automobile sheet metal surface correcting equipment shown in FIG. 1.

The first cover means or cap 11 is formed in an inner surface thereof with a pair of laterally arranged air passages 11A and 11B which cooperate with each other to constitute a part of an air flow path, as shown in FIGS. 5, 6 and 8.

The housing 10, as shown in FIG. 17, is formed at a portion thereof positioned above the first receiving portion 13A with a cylindrical hole 14 so as to extend in a longitudinal or axial direction thereof, in which a bushing 65 is fitted. Also, the housing 10 is formed with a pair of air passages 15 and 16 so as to be positioned on both sides of the cylindrical hole 14. The air passage 15 is arranged so as to communicate with an air outlet hole 67 formed at a lower portion of the bushing 65 positioned on a rear right side thereof when the bushing 65 is fitted in the cylindrical hole 14 of the housing 10. The air passage 16 is adapted to communicate with an air outlet hole 68 formed at a lower portion of the bushing 65 on a front left side thereof when the fitting is made. Also, the air passages 15 and 16 of the housing 10 are arranged so as to communicate with the air passages 11A and 11B of the cap 11, respectively, when the cap 11 is mounted on the housing 10.

Figure 4:
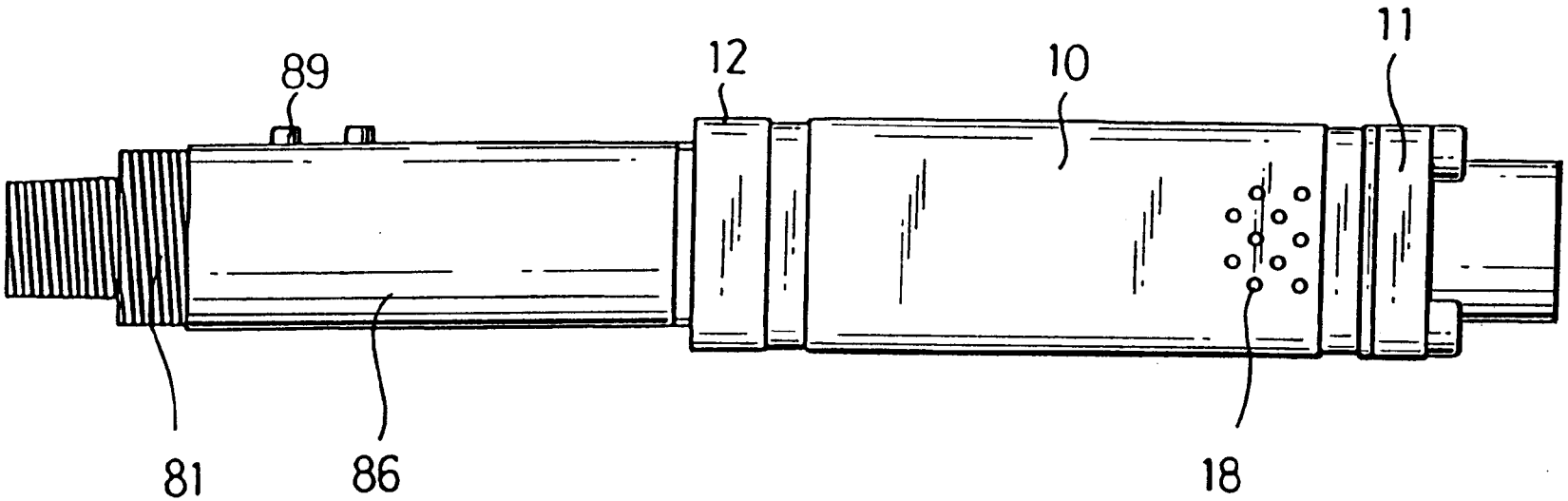
FIG. 4 is a bottom view of the automobile sheet metal surface correcting equipment shown in FIG. 1.
Figure 9:
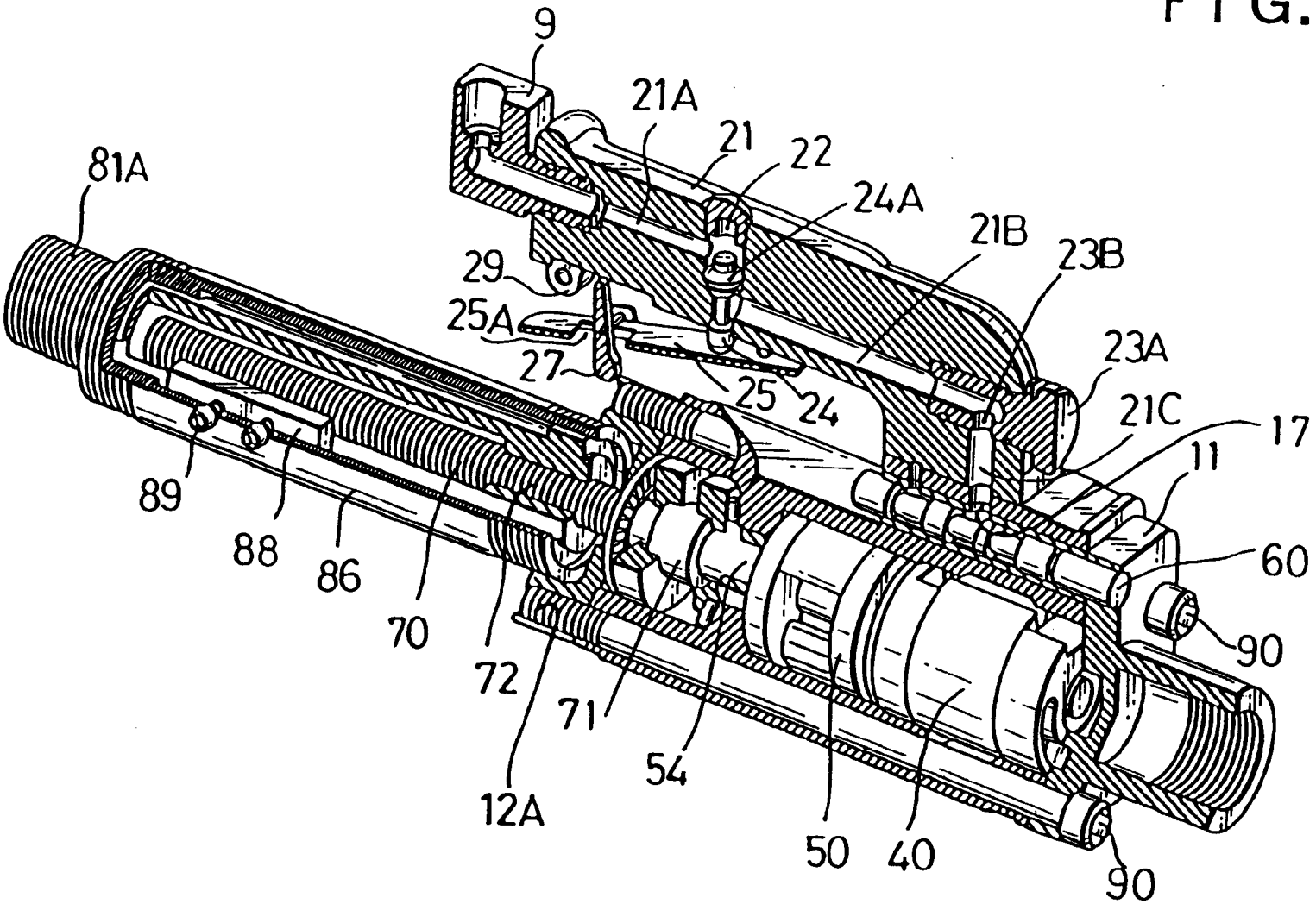
FIG. 9 is a partially cutaway schematic perspective view in section of the automobile sheet metal surface correcting equipment of FIG. 1, which shows an internal structure of the automobile sheet metal surface correcting equipment.

The air introduction means 20, as shown in FIGS. 9 and 17, includes a handle 21, which is formed with an air introduction passage 21C. The housing 10 is provided on an upper surface thereof with a step 10C, which is formed at a central portion thereof with an air introduction hole 17 so as to communicate with the air introduction passage 21C of the handle 21 of the air introduction means 20 when the air introduction means 20 is connected to the housing 10 as described hereinafter. Also, the housing 10, as shown in FIG. 4, is formed on a bottom surface thereof with an exhaust hole 18 in correspondence to an air outlet holes 43A (FIG. 18) formed on a bottom of the cylinder 43, which will be described hereinafter.

The upper step 10C of the housing 10, as shown in FIG. 17, is formed at corners thereof with threaded holes 19. The handle 21 of the air introduction means 20 is placed on the step 10C of the housing 10 and then fixed thereon by threadedly inserting bolts 95 into the threaded holes 19 while ensuring airtight connection therebetween.

The air introduction means 20 includes the above-described handle 21, an air regulator 23 arranged on a proximal end of the handle 21, an air valve 24 arranged on a central portion of a bottom surface of the handle 21, a switch lever 25 disposed on the bottom surface of the handle 21 so as to operate the air valve 24, a control pin 26 for selectively restraining or controlling movement of the switch lever 25, and a stopper 27 pivotally supported in a cutout 25A (FIGS. 1 and 9) formed at a free end of the switch lever 25 so as to be raised therein. The air valve 24 is rendered open by moving or pulling the switch lever 25 toward the bottom surface of the handle 21. Control or regulation of movement of the switch lever 25 by the control pin 26 is carried out in order to maintain the thus-established open state of the air valve 24. Reference numeral 9 designates a connector which is connected to the free end of the handle 21 and through which an air hose is connected to the handle 21.

The handle 21 is formed therein with the air introduction passage 21C, as well as air introduction passages 21A and 21B, through which compressed air is introduced into the housing 10, as shown in FIGS. 9 to 11.

The air regulator 23 includes a knob 23A rotatably attached thereto and is formed therein with a flow control hole 23B (FIG. 9). The air regulator 23 is so constructed that rotation of the knob 23A varies a degree of threaded engagement between the air regulator 23 and the housing 21, to thereby adjust a degree of opening of the flow control hole 23B, resulting in controlling a flow rate of compressed air which flows through the air introduction passage 21C.

The air valve 24 includes a valve body 24A (FIG. 9), which is disposed in a valve chest 22 arranged between the air introduction passages 21A and 21B. In the air valve 24 thus constructed, when the switch lever 25 is operated to upwardly push a lower end of the air valve 24 while abuttedly contacting it with an upper surface of the switch lever 25, the valve body 24A of the air valve 24 is raised from a valve seat in the valve chest 22, resulting in the air valve 24 being open, so that the air introduction passages 21A, 21B and 21C may be permitted to communicate with each other, to thereby permit compressed air introduced into the handle to flow into the housing 10 through the air introduction hole 17 (FIGS. 9 and 17) formed at the step 10C of the upper surface of the housing 10. Then, when the switch lever 25 is returned to its original position as shown in FIGS. 1 to 3, the valve body 24A of the air valve 24 is closed, to thereby isolate the air introduction passages 21A and 21B from each other, resulting in preventing flowing of compressed air from the air introduction passage 21A to the air introduction passage 21B.

Figure 2:
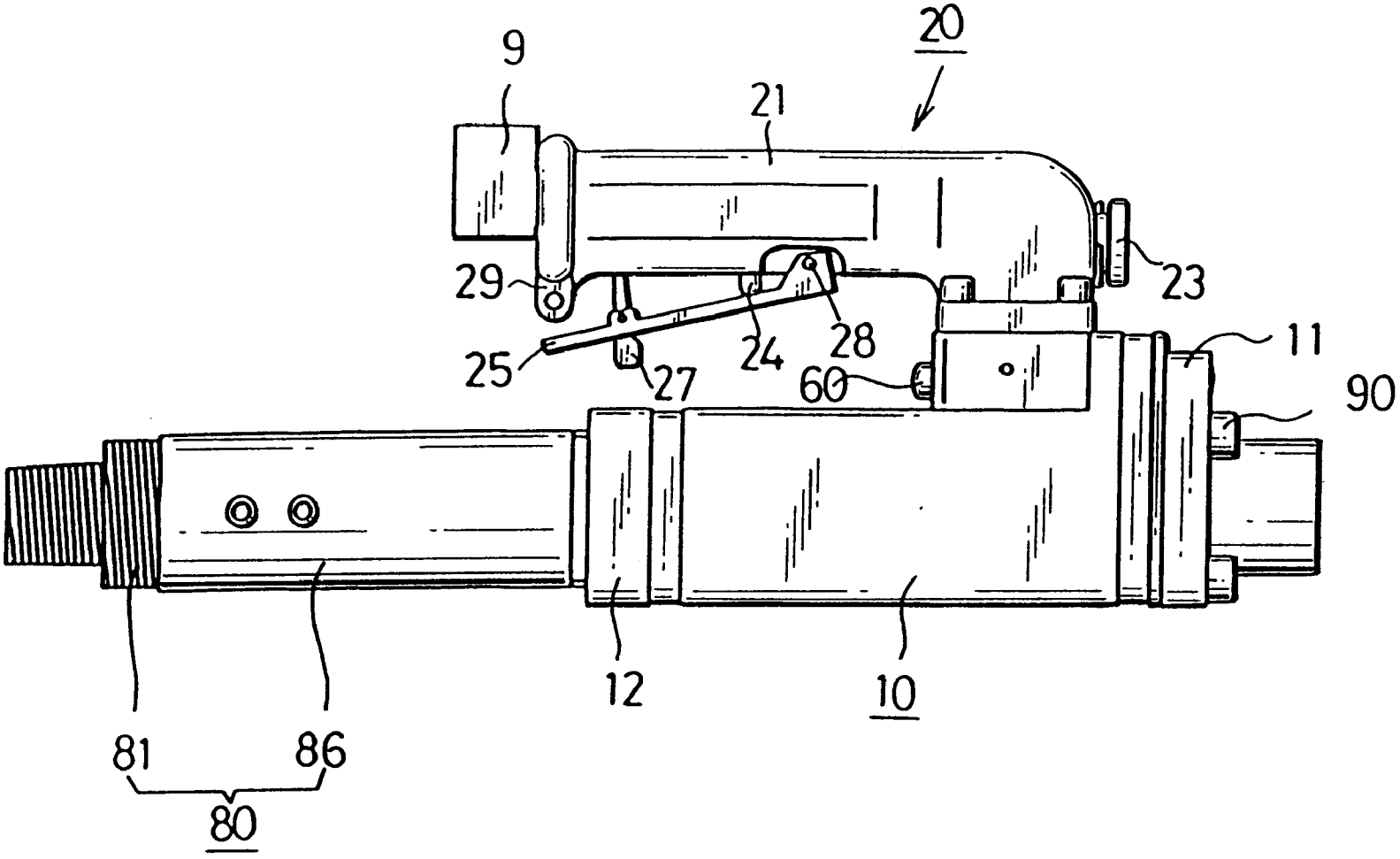
FIG. 2 is a front elevation view of the automobile sheet metal surface correcting equipment shown in FIG. 1.
Figure 3:
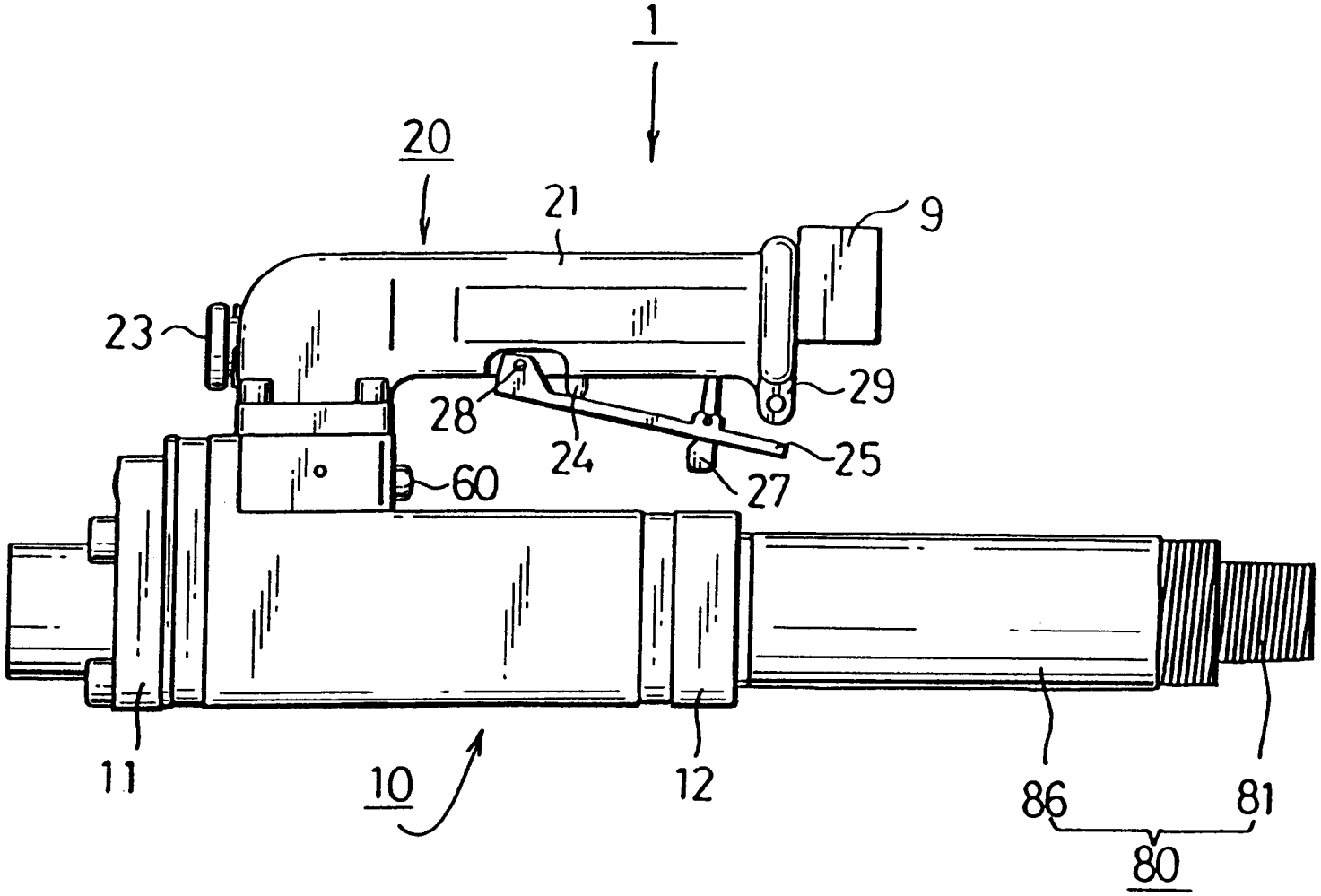
FIG. 3 is a rear elevation view of the automobile sheet metal surface correcting equipment shown in FIG. 1.

The switch lever 25 is pivotally supported at a proximal end thereof on a short pin 28 inserted through insertion holes formed at a central portion of the handle 21 positioned on a bottom side thereof, as shown in FIG. 2.

The control pin 26 is inserted through pin insertion holes 29A (FIGS. 1 and 17) formed via a pair of projections 29 provided on a lower surface of the free end of the handle 21 so as to downwardly extend therefrom, to thereby control or regulate movement of the switch lever 25 raised.

The impact wrench mechanism 30 includes the above-described air motor 40 driven by compressed air fed into the housing 10, as well as an impact wrench 50 actuated by the air motor 40.

Figure 18:
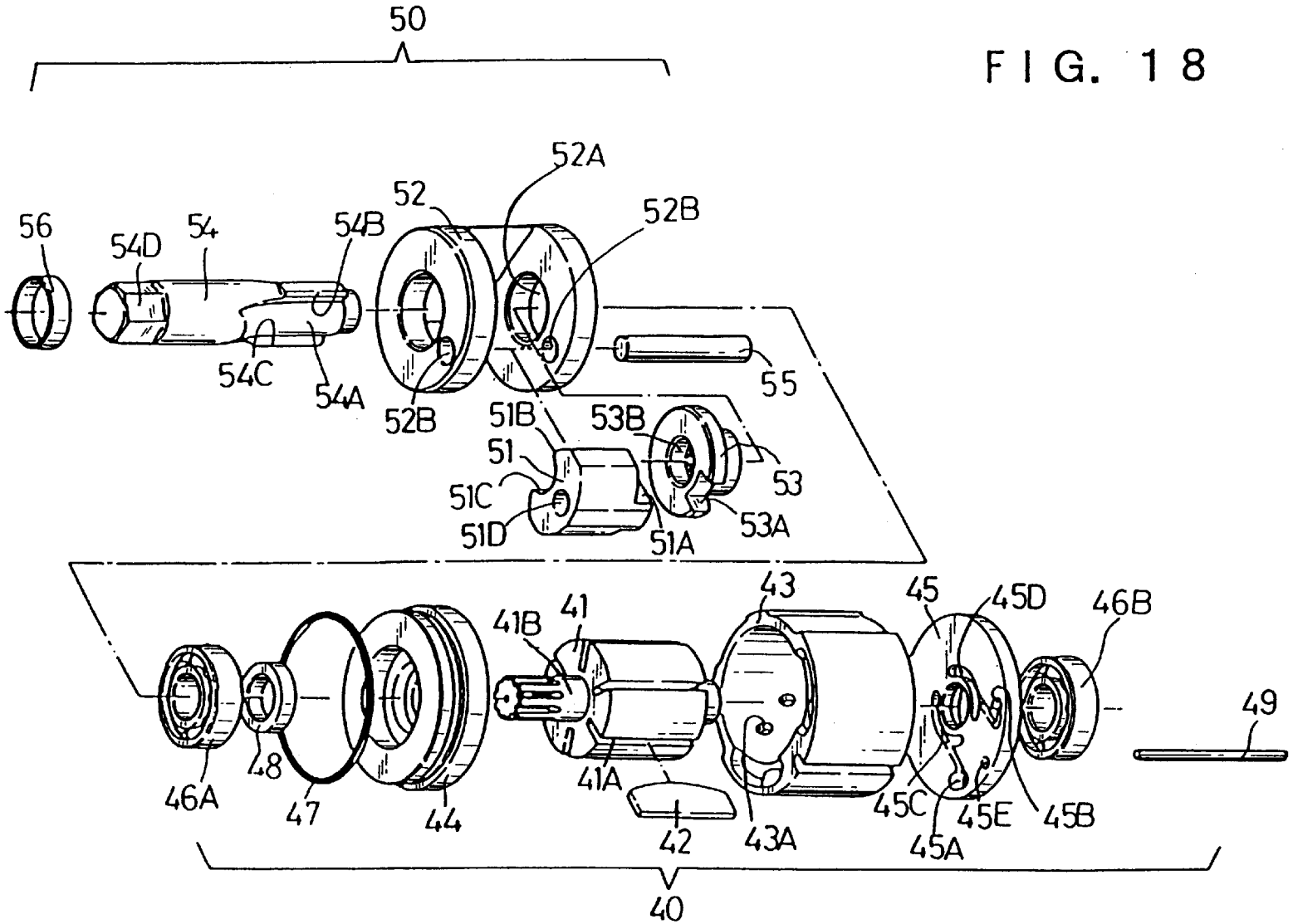
FIG. 18 is an exploded perspective view showing components of an impact wrench mechanism incorporated in the automobile sheet metal surface correcting equipment of FIG. 1.

The air motor 40, as shown in FIG. 18, includes a rotor 41, blades 42 each detachably held in each of slits 41A formed on the rotor 41, a cylinder 43 having the rotor 41 and blades 42 arranged therein, a front plate 44 and a rear plate 45 which cooperate with each other to hold the rotor 41 thereon, a front bearing holder 46A and a rear bearing holder 46B acting to ensure smooth rotation of the rotor 41, an O-ring 47 for preventing air leakage, and an oil seal 48.

The rotor 41 includes a rotor shaft 41B, which is engagedly fitted in a central hole 53B of a cam 53 constituting the impact wrench 50.

The rear plate 45 of the air motor 40 is formed with a pair of air inlet holes 45A and 45B. Also, the rear plate 45 is formed at a portion thereof positioned above the air inlet hole 45A with an air inflow groove 45C. The air inflow groove 45C is arranged so as to start at the air inlet hole 45A, to thereby permit compressed air to be fed through the air inflow groove 45C toward the rotor 41. Also, the rear plate 45 is formed at a portion thereof above the air inlet hole 45B with an air inflow groove 45D, which is arranged so as to start at the air inlet hole 45B, so that compressed air for reverse rotation of the rotor 41 may be fed through the air inflow groove 45D toward the rotor 41.

The rear plate 45 and front plate 44 are connected to each other through a pin 49 inserted via a through-hole 45E of the rear plate 45.

The impact wrench 50, as shown in FIG. 18, includes a hammer 51, a hammer frame 52, a spindle 54 (impact output shaft) for transmitting rotation of the air motor 40 to the screw bolt 70, a cam 53 for transmitting rotation of the rotor 41 to the hammer 51, hammer frame 52 and spindle 54, and a hammer pin 55 constituting a shaft body of the hammer 51. The hammer 51 is provided with a projection 51A and correspondingly the cam 53 is formed with a cutout 53A, so that the projection 51A of the hammer 51 may be loosely fitted in the cutout 53A of the cam 53.

The hammer 51 includes outer peripheral end surfaces 51B and 51C. The spindle 54 is formed with a recess 54A, which includes holding surfaces 54B and 54C. The hammer 51 is so constructed that the outer peripheral end surface 51B may be held on the holding surface 54B of the recess 54A when the hammer 51 is rotated together with the hammer frame 52 in a counterclockwise direction. Also, when the hammer 51 is rotated together with the hammer frame 52 in a clockwise direction, the outer peripheral end surface 51C of the hammer 51 may be held on the holding surface 54C of the spindle 54. Also, the spindle 54 includes a distal end 54D and is engaged at the distal end 54C with the bolt head 71 of the screw bolt 70.

The hammer frame 52 is formed at a center thereof with an insertion hole 52A, through which the rotor shaft 41B is inserted. Also, the hammer frame 52 is formed with a bearing hole 52B at a portion thereof deviated toward an outer periphery thereof from the insertion hole 52A. In addition, the hammer 51 is formed with a through-hole 51D. The hammer 51 is arranged so as to be inserted through the bearing hole 52B and the through-hole 51D of the hammer 51 and then supported on the hammer frame 52. Such construction permits the hammer 51 to be actuated about the hammer pin 55. In FIG. 18, reference numeral 56 designates a collar.

When any load is initially kept from being applied to a distal end of the piston 81 irrespective of driving of the air motor 40, the hammer 51, hammer frame 52, spindle 54 and screw bolt 70 are integrally rotated, so that the piston 81 may be retractably moved with respect to the cylinder 86 or advanced or retracted with respect to the cylinder 86.

Then, when such movement of the piston 81 is further carried out to start application of the load to the piston 81, so that further turning force is required to actuate the screw bolt 70, the cam 53 supported on the rotor shaft 41B of the rotor 41 temporarily pushes the hammer 51 upwardly.

Thus, when the piston 81 is kept advancing from the cylinder 86, engagement between the holding surface 54B of the spindle 54 and the outer peripheral end surface 51B of the hammer 51 is released, so that the hammer 51 may be rotated once together with the hammer frame 52. During such one rotation, the hammer 51 is pushed down while being guided by movement of the cam 53. Then, after the one rotation, the outer peripheral end surface 51B of the hammer 51 is caused to be held on the holding surface 54B of the spindle 54. Thus, shock is applied to the spindle 54, to thereby rotate the screw bolt, leading to further advancing of the piston 81. When the piston 81 is retracted, engagement between the holding surface 54C of the spindle 54 and the outer peripheral end surface 51C of the hammer 51 is released, so that the hammer 51 may be rotated once together with the hammer frame 52. During such one rotation, the hammer 51 is pushed down while being guided by movement of the cam 53. Then, when the one rotation is completed, the outer peripheral surface 51C of the hammer 51 is held on the holding surface 54C of the spindle 54 again. Thus, shock is applied to the spindle 54, resulting in the screw bolt 70 being rotated, leading to further retraction of the piston 81.

The rotation direction changing-over valve 60 is received at a large part thereof in the bushing 65 while exhibiting a satisfactory changing-over function, as shown in FIGS. 10 and 11. Also, the rotation direction changing-over valve 60 is arranged while keeping both ends thereof projected from the bushing 65.

The rotation direction changing-over valve 60 thus constructed functions to change over the air flow path of compressed air introduced through the air introduction means 20 to change a direction of rotation of the air motor 40 constituting the impact wrench mechanism 30.

For this purpose, the rotation direction changing-over valve 60 is formed with two grooves 61 and 62, as shown in FIGS. 10, 11 and 17. The grooves 61 and 62 contribute to changing-over of air passages formed in the housing (or first and second air passages described hereinafter). More particularly, forcing of the rotation direction changing-over valve 60 in a forward direction as shown in FIG. 10 permits air to flow through the groove 61 positioned rearwardly of the bushing 65 and the air inlet hole 45A of the rear plate 45 (FIG. 18) to an air inlet port 40A of the air motor 40 (FIGS. 5 and 6), resulting in the air motor 40 being rotated in a counterclockwise direction or left-hand direction. This permits the spindle 54 of the impact wrench 50 to be likewise rotated in the counterclockwise direction, leading to rotation of the screw bolt 70. This results in the piston 81 outwardly advancing from the cylinder 86 or transferring from a state shown in FIGS. 1, 9 and 10 to that shown in FIGS. 12 and 15.

To the contrary, when the rotation direction changing-over valve 60 is pushed rearwardly as shown in FIG. 11, air is permitted to flow to the forward groove 62 of the bushing 65. Then, the air enters an air inlet port 40B (FIGS. 5 and 6) of the air motor 40 through the air passage 11B (FIG. 8) of the cap 11 and the air inlet hole 45B (FIG. 18) of the rear plate 45, leading to rotation of the air motor 40 in the clockwise direction or right-hand direction. This permits the spindle 54 of the impact wrench 50 to be likewise rotated in the clockwise direction, to thereby rotate the screw bolt 70. This results in the piston 81 being retracted into the cylinder 86 or transferred from a state shown in FIGS. 12 and 15 to that shown in FIGS. 1, 9 and 10.

The bushing 65 is formed at a substantially central portion of an upper surface thereof with an air inlet hole 66, at a lower portion thereof positioned on a rear right-hand side thereof with the air outlet hole 67 and at a lower portion thereof positioned on a front left-hand side thereof with the air outlet hole 68, as shown in FIGS. 10 and 11. Such construction, when the rotation direction changing-over valve 60 is forwardly forced out, permits compressed air to flow through the air inlet hole 66, the groove 61 of the rotation direction changing-over valve 60 and the air outlet hole 67 and then be guided through the air passage 11A of the cap 11 toward the air inlet port 40A of the air motor 40 as shown in FIGS. 5 and 10.

When the rotation direction changing-over valve 60 is kept forwardly forced out, compressed air is guided through the air outlet hole 68, the groove 62 of the rotation direction changing-over valve 60, the air outlet hole 68 and the air passage 11B of the cap 11 toward the air inlet port 40B of the motor 40 as shown in FIGS. 6 and 11.

Thus, in the housing 10, the air introduction hole 17, air inlet hole 66, air outlet hole 67, air passage 15, air passage 11A, air inlet hole 45A and air inflow groove 45C cooperate with each other to constitute a first air flow path. Likewise, the air introduction hole 17, air inlet hole 66, air outlet hole 68, air passage 16, air passage 11B, air inlet hole 45B and air inflow groove 45D cooperate together to provide a second air flow path.

The screw bolt 70, as described above, has revolving force applied thereto from the impact wrench mechanism 30. This results in a receiving portion formed on the bolt head 71 of the screw bolt 70 being engaged with the spindle 54 of the impact wrench 50 constituting the impact wrench mechanism 30.

Figure 12:
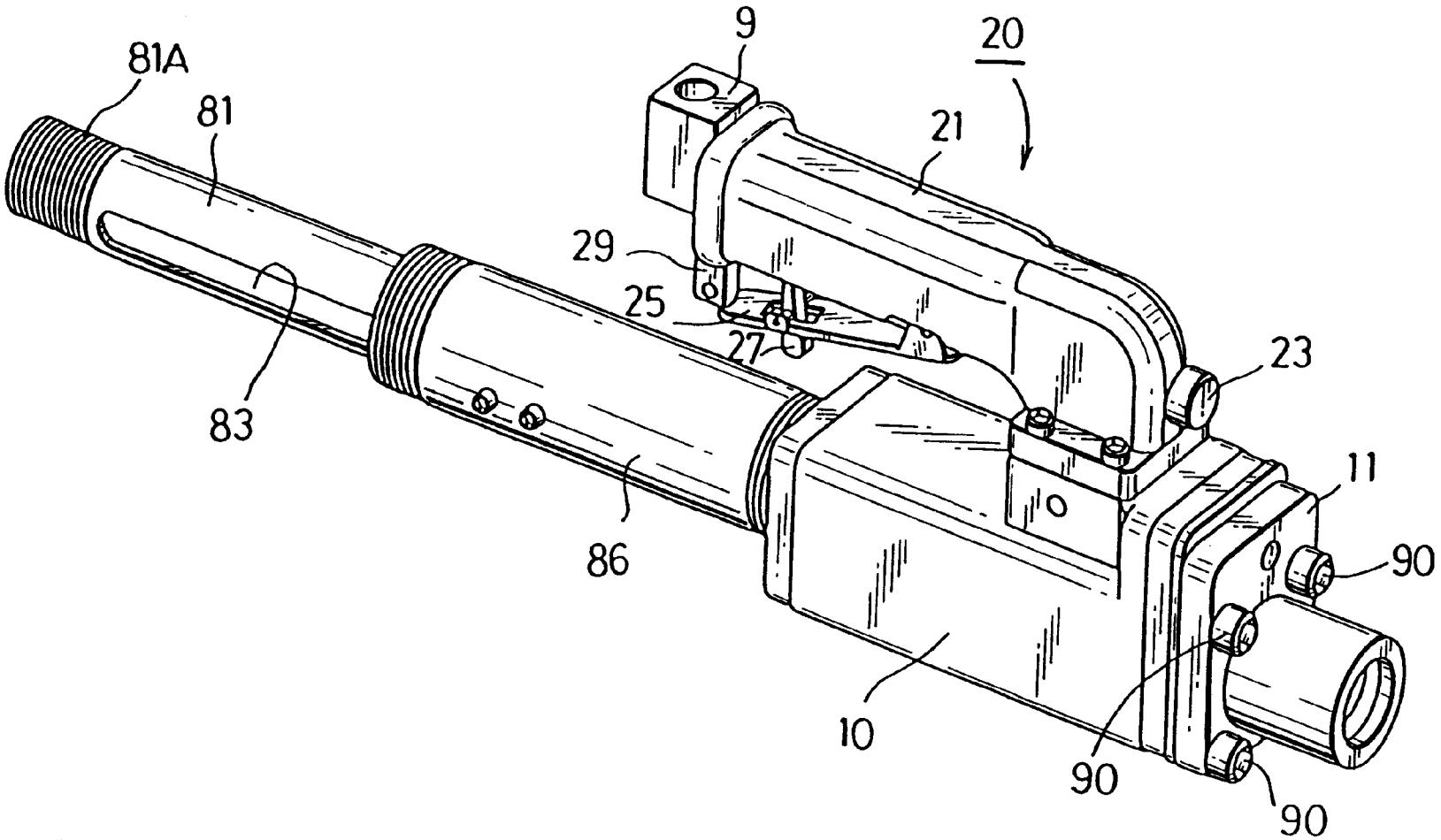
FIG. 12 is a perspective view of the automobile sheet metal surface correcting equipment shown in FIG. 1, in which a piston is kept extended or advanced.
Figure 13:
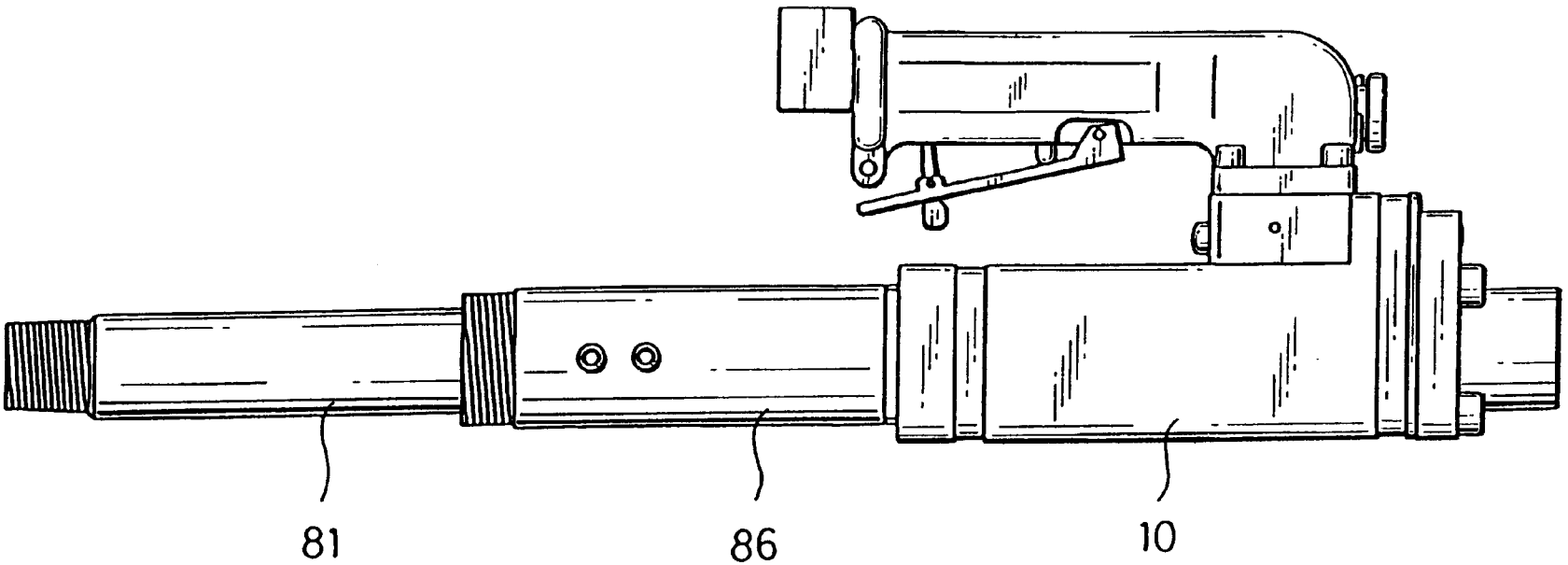
FIG. 13 is a front elevation view of the automobile sheet metal surface correcting equipment shown in FIG. 1, in which a piston is kept extended.
Figure 14:
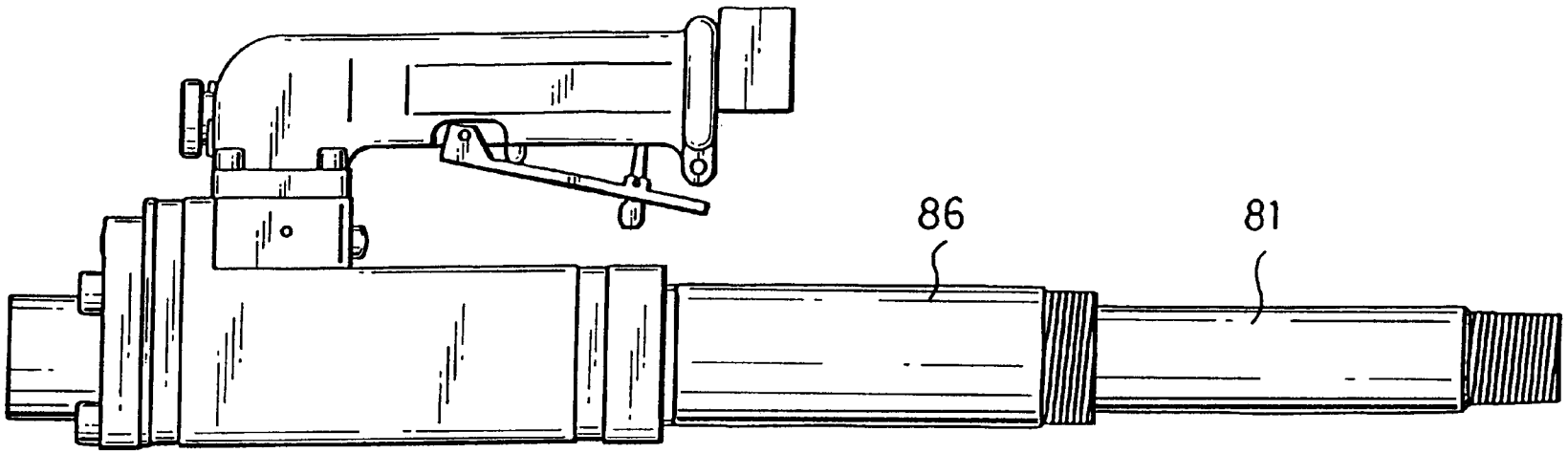
FIG. 14 is a rear elevation view of the automobile sheet metal surface correcting equipment shown in FIG. 1, in which a piston is kept extended.

In the illustrated embodiment, the piston mechanism 80 is constituted by the piston 81, the cylinder 86 and a piston guide member 88. The piston 81 is constructed into a cylindrical structure, resulting in being formed therein with a central hole which extends in an axial direction thereof. An inner surface of the piston 81 which defines the central hole of the piston 81 is formed with threads, which are threadedly engaged with threads 72 of the screw bolt 70. Also, the piston 81 is formed on an outer peripheral surface thereof with an elongated guide groove 83 so as to extend in a longitudinal direction thereof, as shown in FIG. 12. Further, the piston 81 is formed on a portion of the outer peripheral surface thereof positioned on a free end side thereof with a threads 81A, on which an attachment 155 (FIG. 22) is threadedly fitted.

Figure 15:
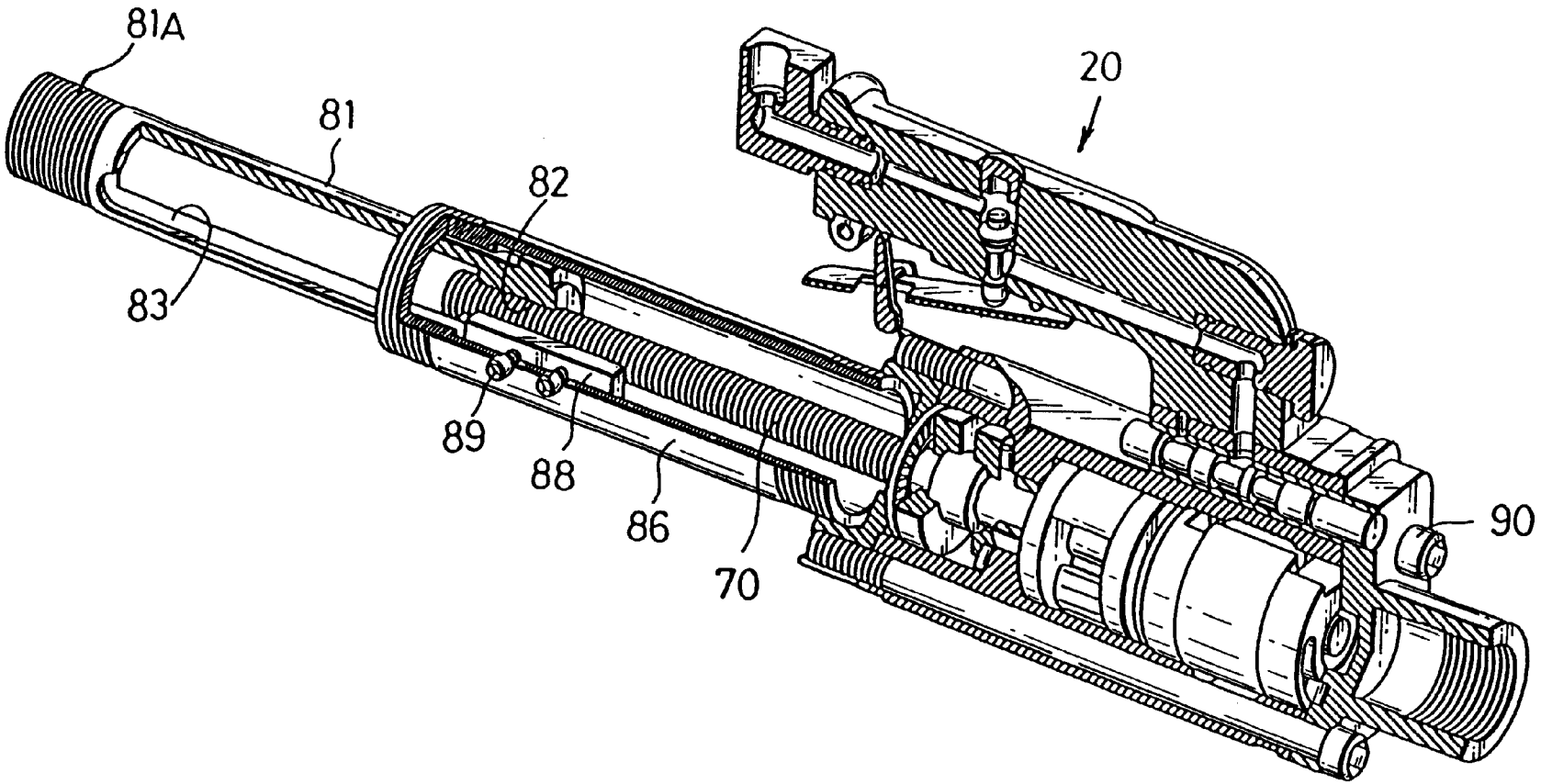
FIG. 15 is a schematic perspective view showing an internal structure of the automobile sheet metal surface correcting equipment of FIG. 1, in which a piston is kept extended.

The cylinder 86 and piston guide member 88 cooperate with each other to prevent rotation of the piston 81, to thereby ensure smooth reciprocation of the piston 81. The cylinder 86 acts to guide the piston 81 therein during reciprocation of the piston 81 therein. The piston guide member 88 is fixedly mounted on an inner peripheral surface of the cylinder 86 by means of screws 89 as shown in FIG. 15.

The first cover means or cap 11, housing 10 and second cover means or cover 12 are integrally connected to each other by means of the four holding bolts 90 inserted through the corners of the housing 10. This results in the holding bolts 90 each being threadedly fitted at a distal end thereof in a threaded portion 12A of the second cover means 12, as shown in FIG. 9.

Compressed air is fed to the automobile sheet metal surface correcting equipment 1 from a compressor 210 connected thereto through a connector 9 and an air hose 230. When the air valve 24 is kept closed, such feeding of compressed air permits the air to reach the air passage 21A in the handle 21. At this time, when the switch lever 25 is raised, the air passages 21A, 21B and 21C are permitted to communicate with each other, resulting in the air flowing into the housing 10 through the air introduction hole 17 of the housing 10. In this instance, when the rotation direction changing-over valve 60 is kept forced in the right-hand direction as shown in FIG. 10, the air is permitted to flow through the groove 61 of the rotation direction changing-over valve 60, the air passage 11A of the cap 11 and the air inlet hole 45A of the rear plate 45 of the air motor 40, to thereby abut against the blades 42, so that the rotor 41 may be rotated in the counterclockwise direction, leading to advancing of the piston 81.

Figure 19:
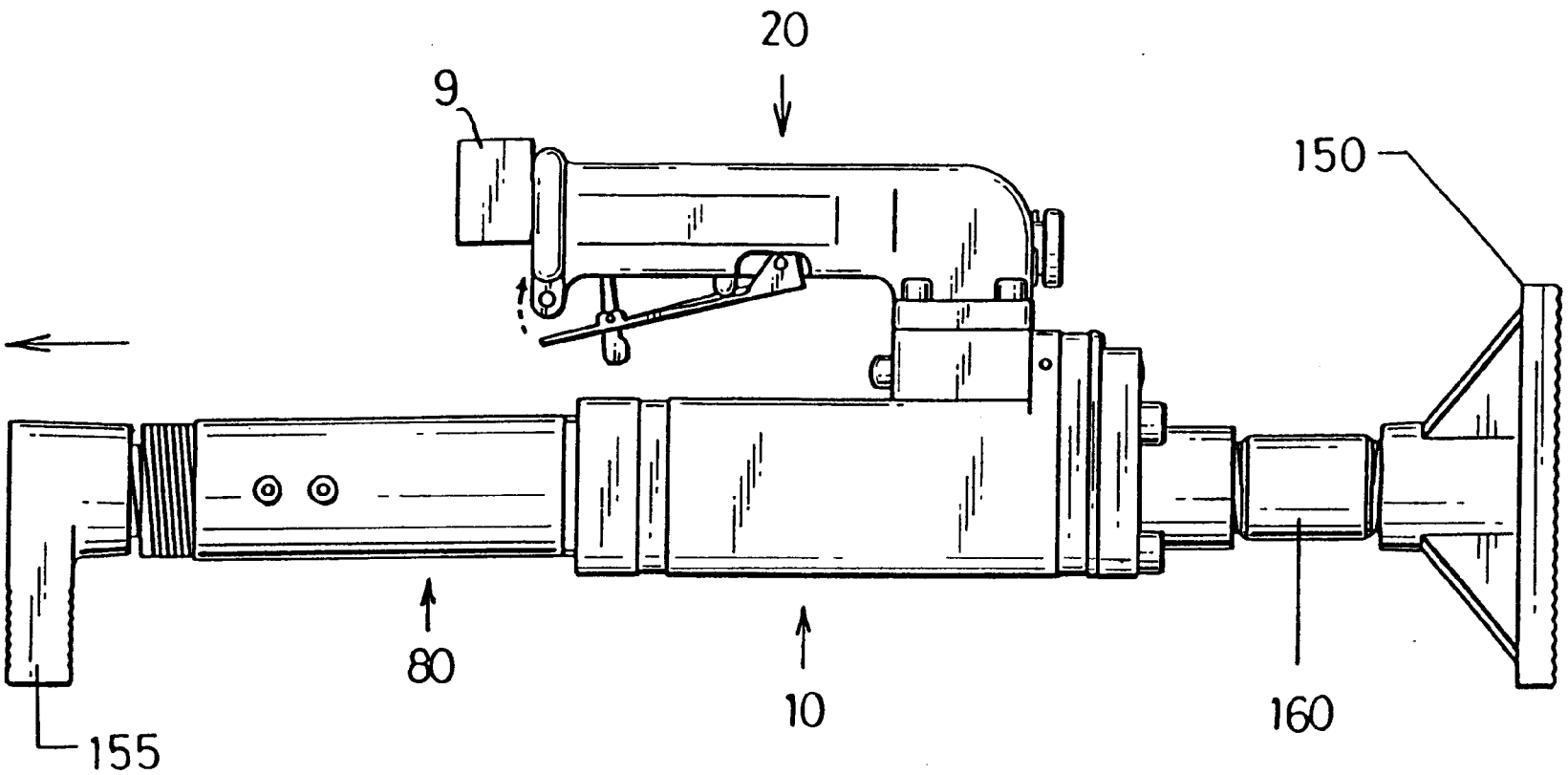
FIG. 19 is a front elevation view showing the automobile sheet metal surface correcting equipment of FIG. 1 having an attachment attached thereto.
Figure 20:
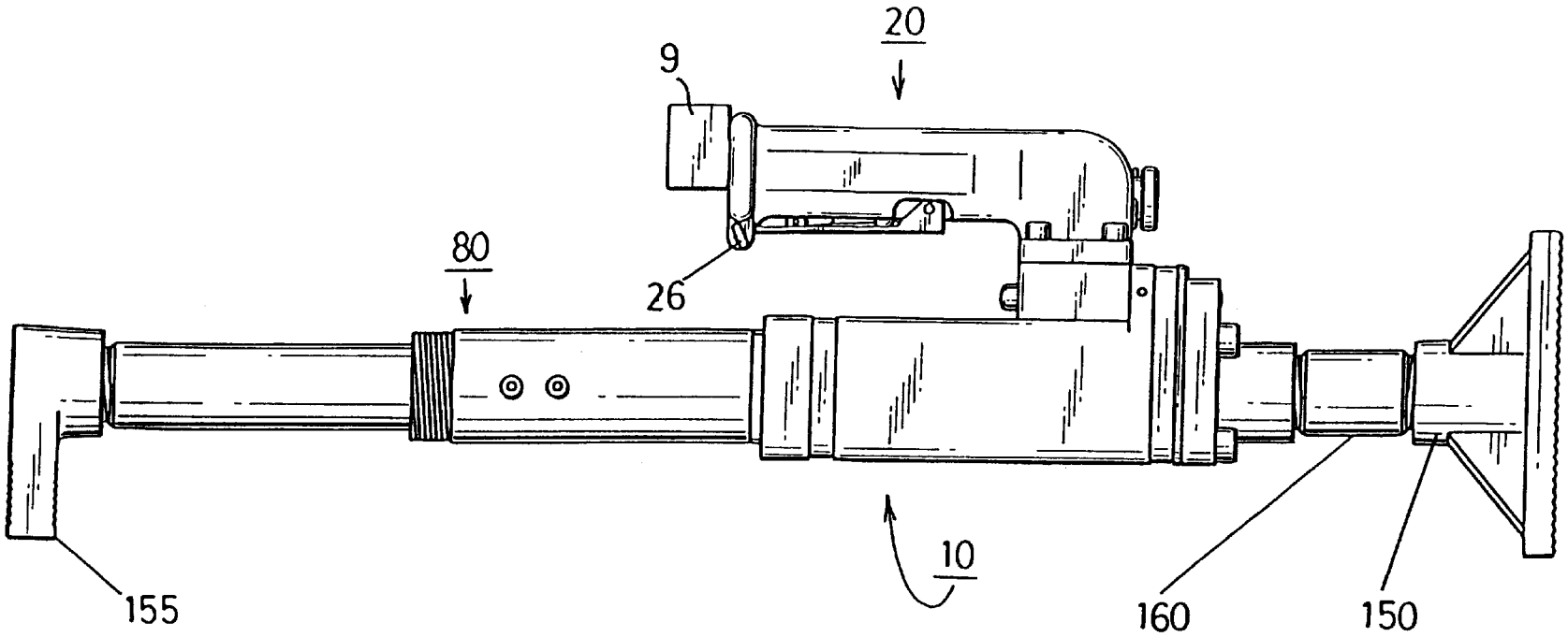
FIG. 20 is a front elevation view showing the automobile sheet metal surface correcting equipment of FIG. 1 having an attachment attached thereto, in which a switch lever is locked by means of a control pin after being operated and a piston is kept extended.
Figure 21:
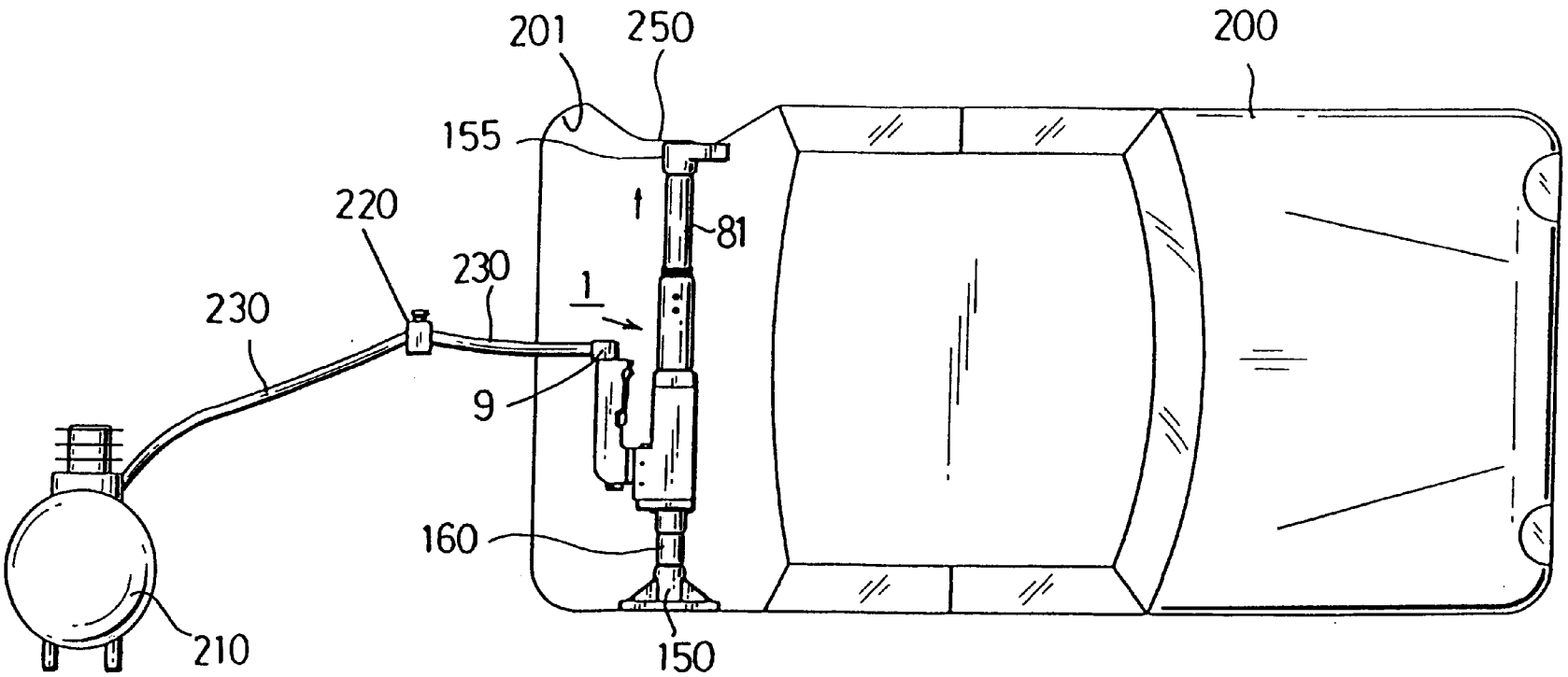
FIG. 21 is a schematic plan view showing correcting operation for forcing out a depression of a quarter panel of a trunk room of an automobile by means of the automobile sheet metal surface correcting equipment of FIG. 1 having an attachment attached thereto.
Figure 22:
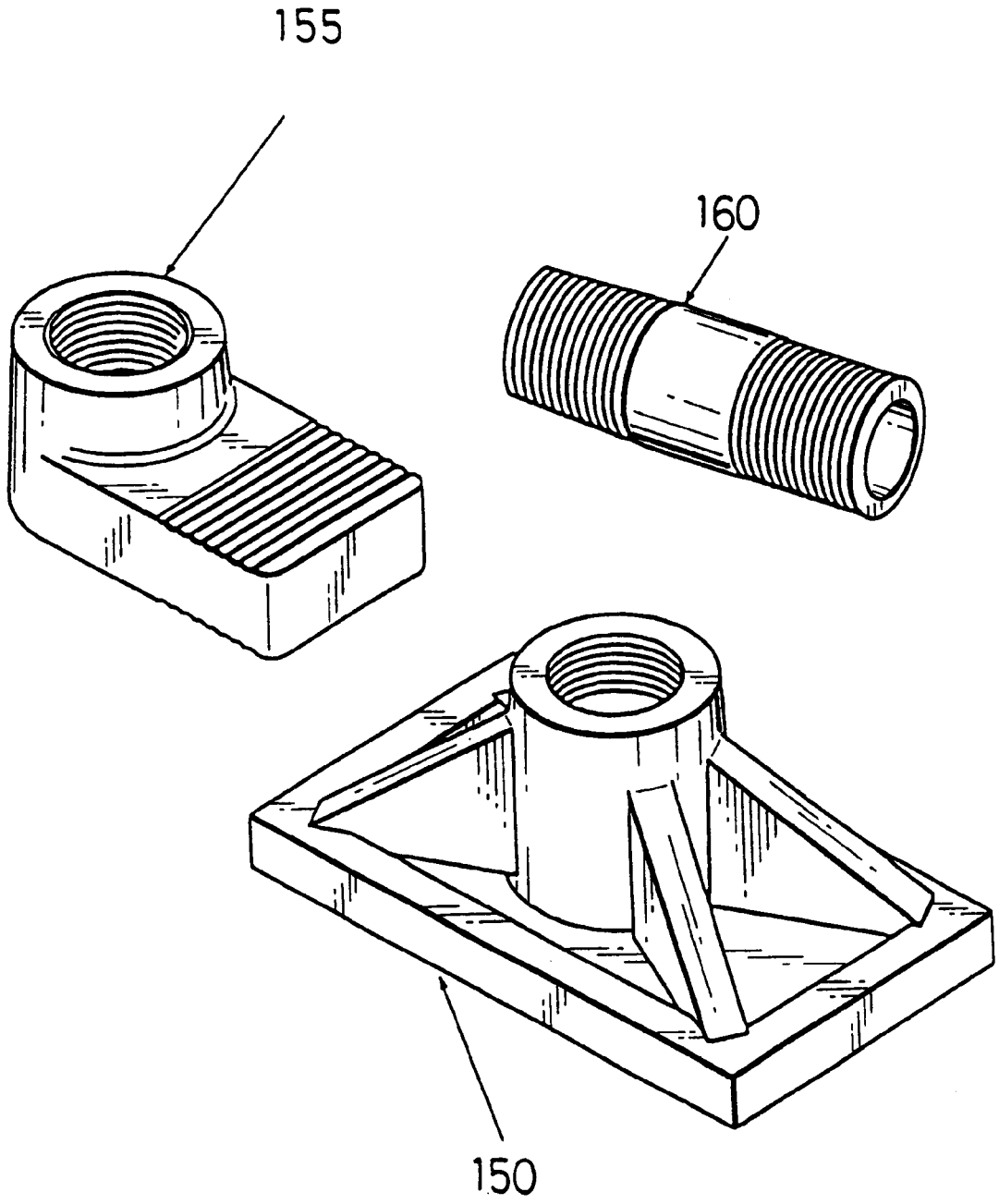
FIG. 22 is a perspective view showing examples of an attachment which may be attached to the automobile sheet metal surface correcting equipment of FIG. 1 as desired.

Now, the manner of operation of the thus-constructed automobile sheet metal surface correcting equipment 1 of the illustrated embodiment will be described hereinafter with reference to FIGS. 19 to 21 in connection with correction or removal of an inward projection 250 generated on a quarter panel of a trunk room 201 of an automobile 200 by an accident or the like by way of example.

An attachment 150, the attachment 155 or an attachment 160 (FIG. 22) is attached to the sheet metal surface correcting equipment 1 as required. Then, the compressor 210 and sheet metal correcting equipment 1 are connected to each other through the connector 9 and air hose 230, as shown in FIG. 21. Subsequently, the attachment 155 is applied to the projection 250 to be connected, as shown in FIG. 21. Thereafter, the lever switch 25 is operated to advance the piston 81, to thereby correct the projection 250.

In this instance, the above-described operation may be roughly carried out to set the sheet metal correcting equipment 1 on the sheet metal surface or the projection 250 so as to prevent the equipment 1 from being detached from the projection 250. Then, an air ON/OFF switch 220 arranged at an intermediate portion of the air hose 230 may be turned off once and the switch lever 26 may be held by the stopper pin 26 while keeping the switch lever 25 raised. Thereafter, the air ON/OFF switch 220 may be turned on for remote control.

Now, operation of pulling a recess 251 on a door panel 202 of the automobile 200 to flatten it will be described with reference to FIGS. 23 to 26.

Figure 23:
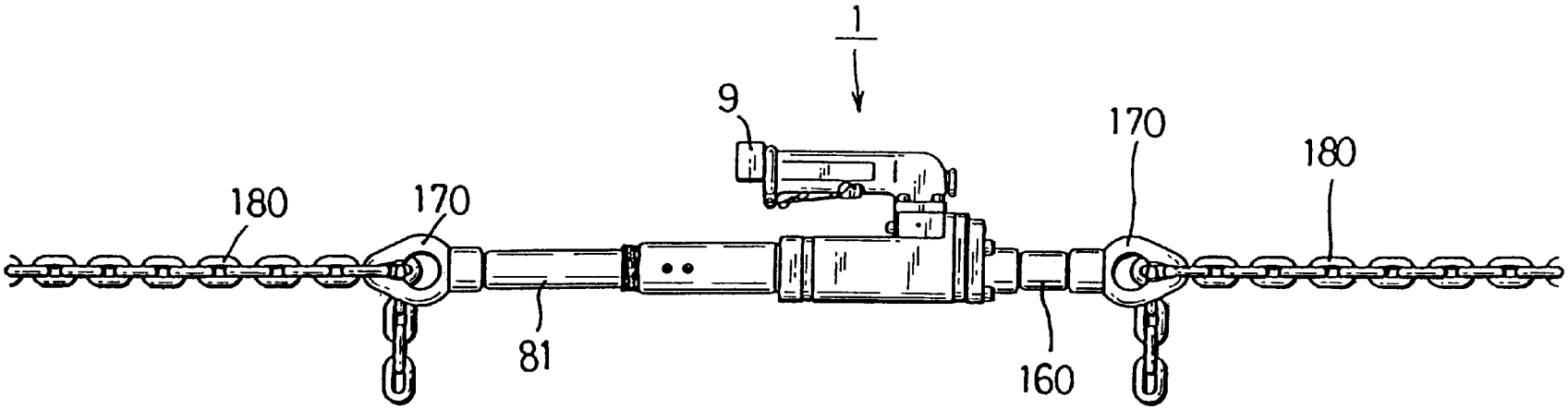
FIG. 23 is a front elevation view showing the automobile sheet metal surface correcting equipment of FIG. 1 having an attachment attached thereto, in which a switch lever is locked by means of a control pin after being operated and a piston is kept extended.
Figure 24:
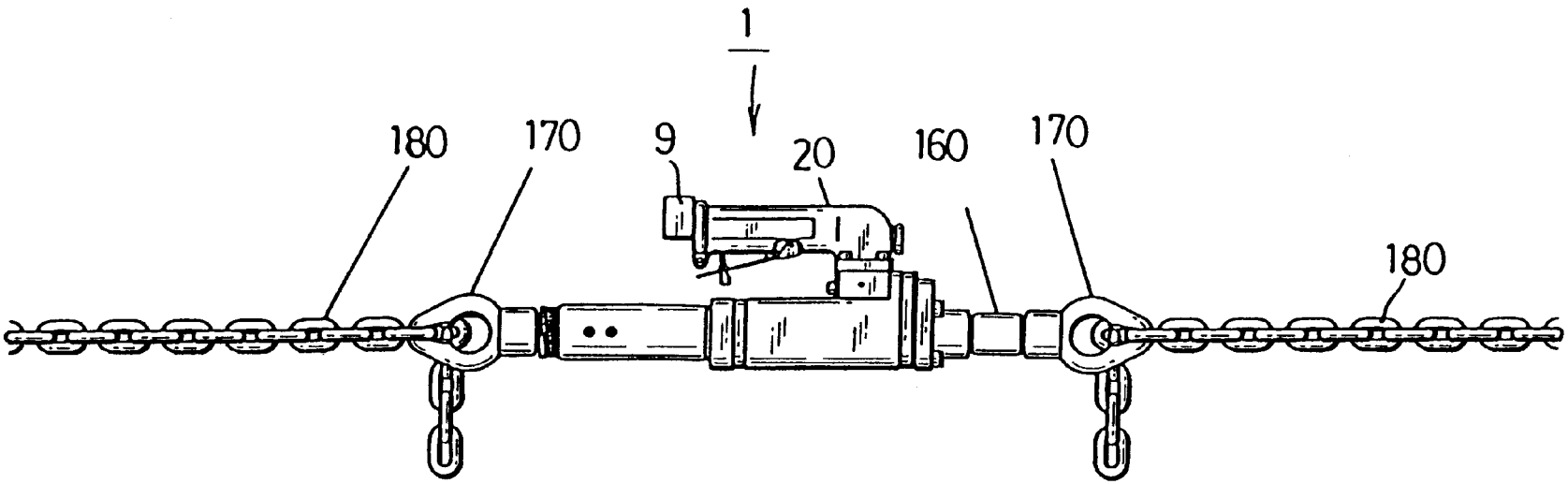
FIG. 24 is a front elevation view showing the automobile sheet metal surface correcting equipment of FIG. 1 having an attachment attached thereto, in which a switch lever is locked by means of a control pin after being operated and a piston is retracted into a cylinder.
Figure 25:
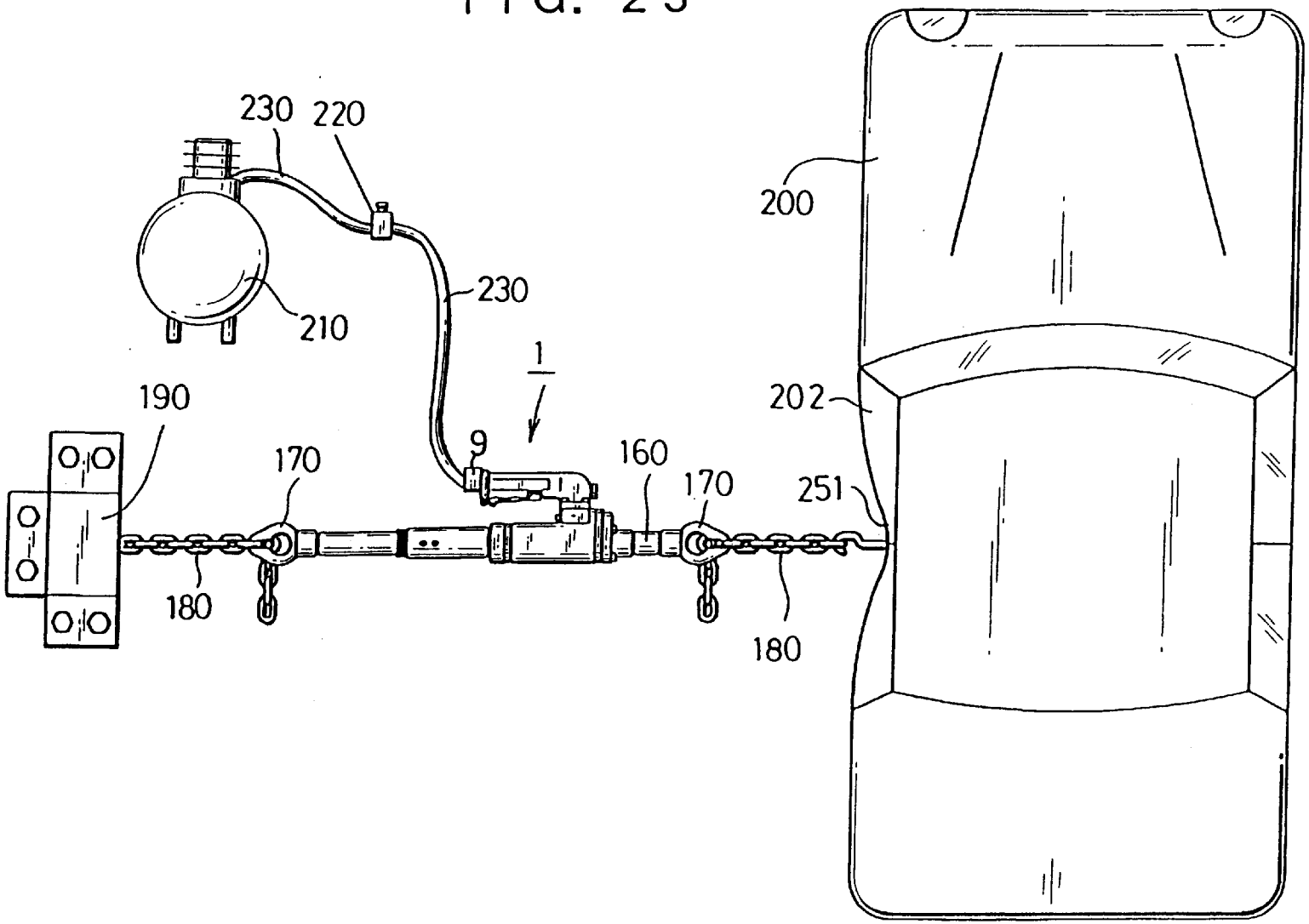
FIG. 25 is a schematic plan view showing correcting operation for pulling out a depression of a door panel of an automobile by means of the automobile sheet metal surface correcting equipment of FIG. 1 having an attachment attached thereto.
Figure 26:
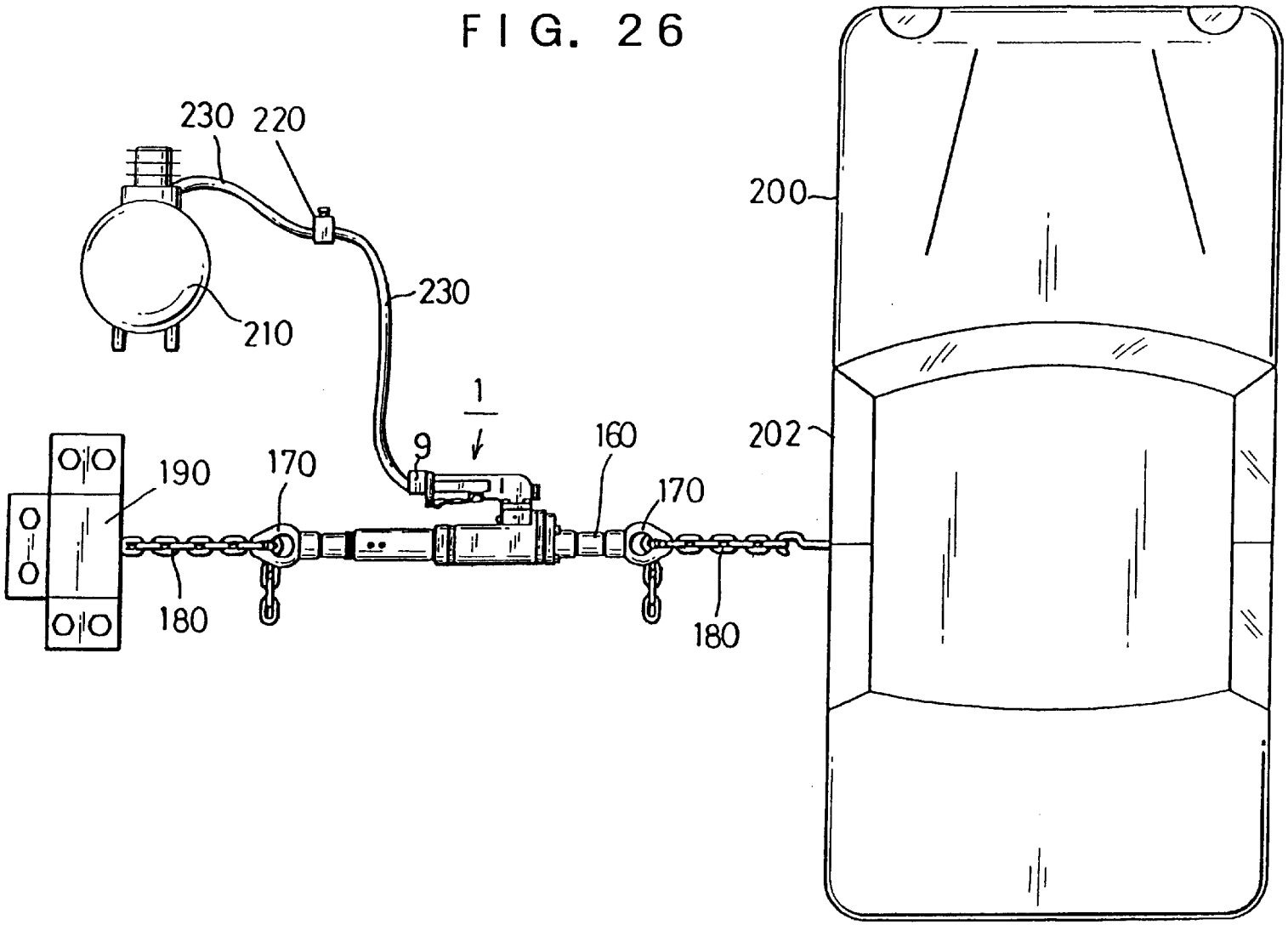
FIG. 26 is a schematic plan view showing correcting operation in which a depression of a door panel of an automobile has been pulled out by means of the automobile sheet metal surface correcting equipment of FIG. 1 having an attachment attached thereto.
Figure 27:
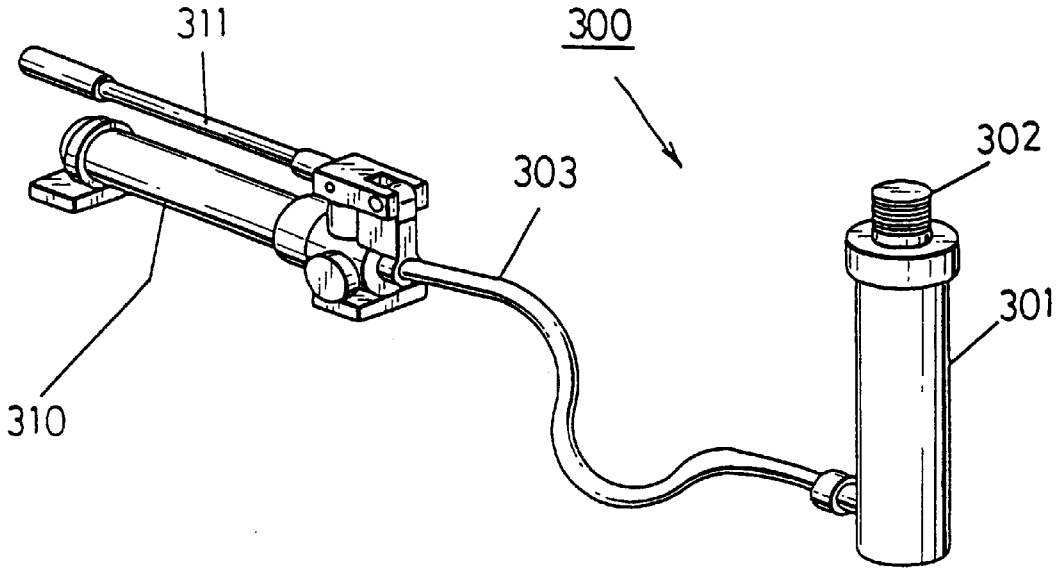
FIG. 27 PRIOR ART
FIG. 27(A) is a perspective view showing a conventional automobile sheet metal surface correcting equipment while keeping a piston from being projected or advanced.
FIG. 27(B) is a perspective view of the conventional automobile sheet metal surface correcting equipment shown in FIG. 27(A) after the piston is projected or advanced.
Figure 27:
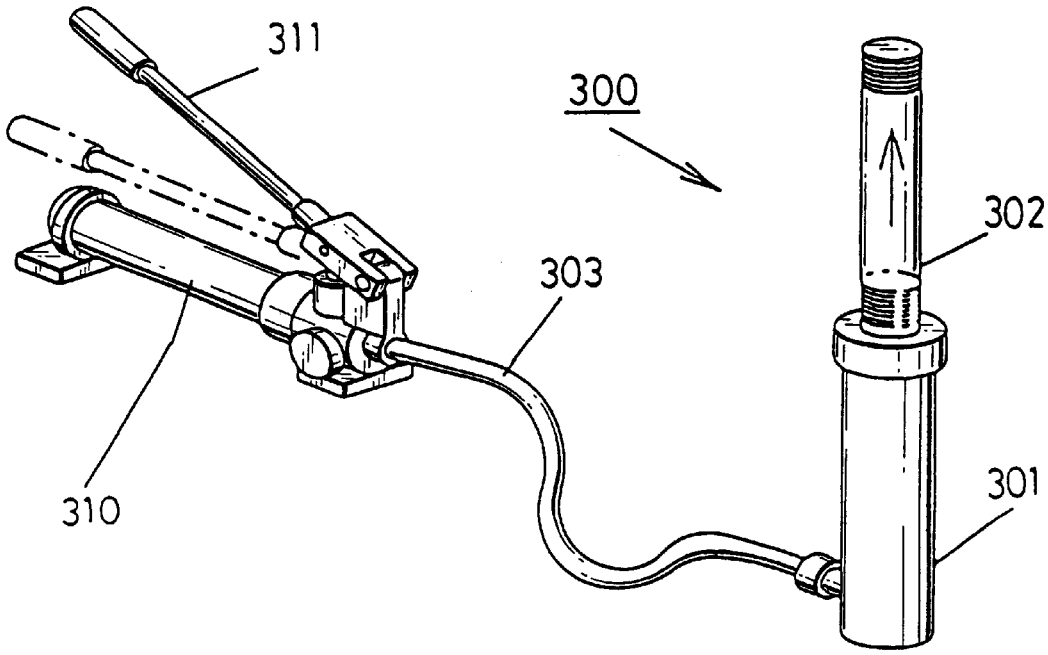
FIG. 27 PRIOR ART
Figure 28:
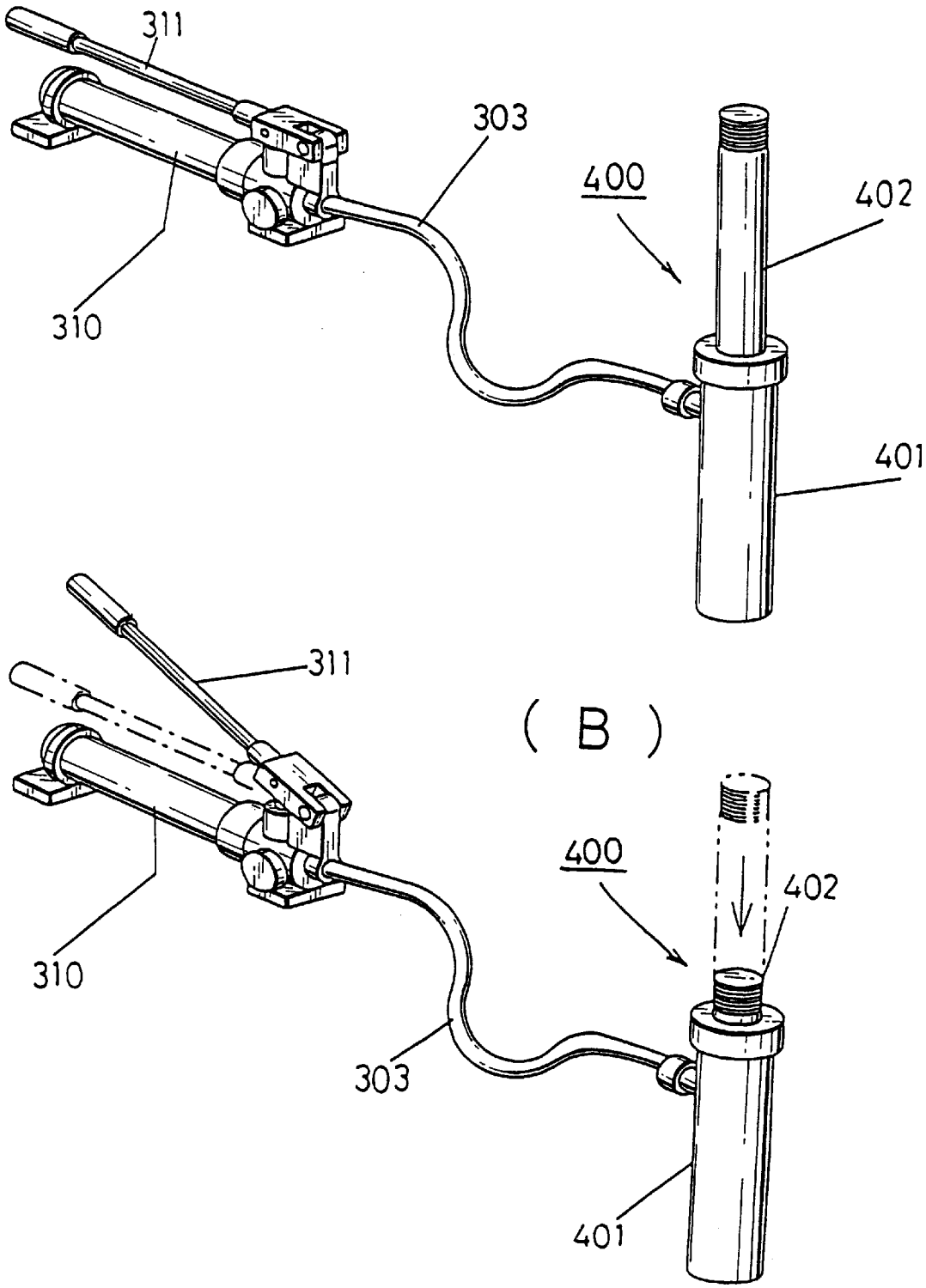
FIG. 28 PRIOR ART
FIG. 28(A) is a perspective view showing another automobile sheet metal surface correcting equipment while keeping a piston projected or advanced.
FIG. 28(B) is a perspective view of the conventional automobile sheet metal surface correcting equipment shown in FIG. 28(A) while keeping the piston retracted.
Figure 29:
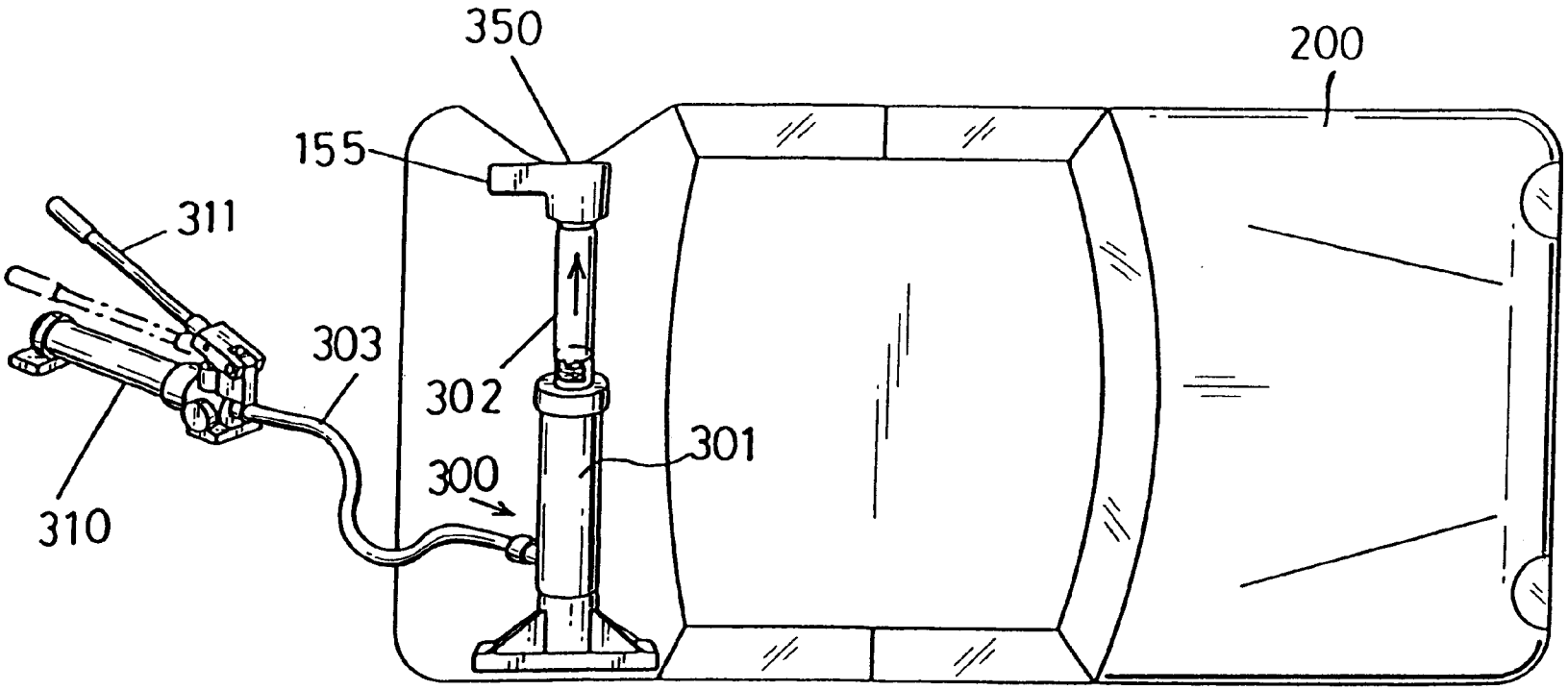
FIG. 29 PRIOR ART
FIG. 29 is a schematic plan view showing correcting operation for forcing out an inward projection or depression of a quarter panel of a trunk room of an automobile by means of the conventional automobile sheet metal surface correcting equipment of FIGS. 27(A) and 27(B)
Figure 30:
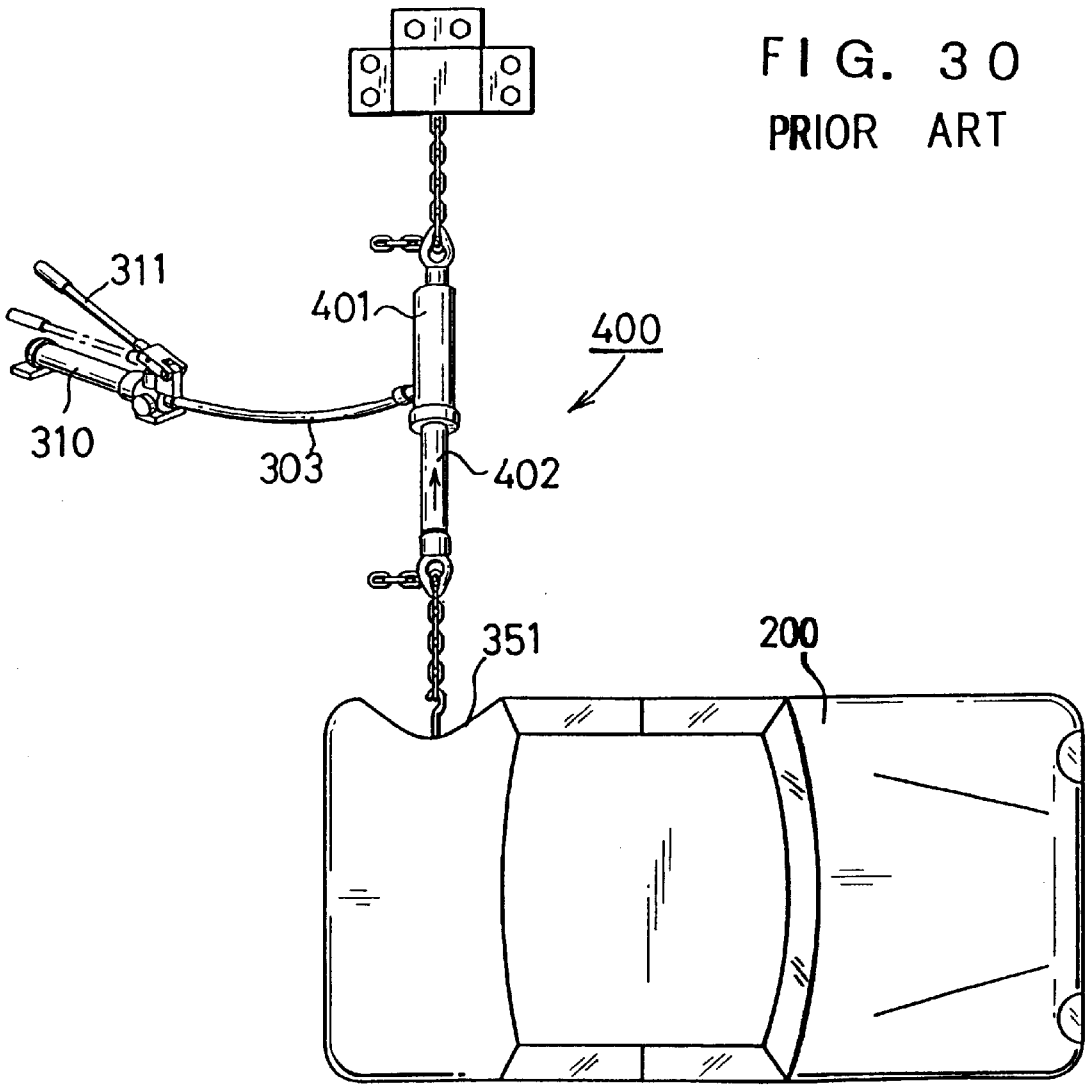
FIG. 30 PRIOR ART
FIG. 30 is a schematic plan view showing correcting operation for drawing or pulling out a depression of a quarter panel of a trunk room of an automobile by means of the conventional automobile sheet metal surface correcting equipment of FIGS. 28(A) and 28(B).

First, the compressor 210 and automobile sheet metal correcting equipment 1 are connected to each other through the connector 9 and air hose 230. Then, the air ON/OFF switch 220 is operated to set the piston at a projected or advanced state, as shown in FIG. 23. Thereafter, a first chain 180 is attached to the sheet metal correcting equipment 1 through the attachment 160 and an attachment 170, as shown in FIGS. 23 and 24. Then, a second chain 180 is connected at a distal end to a support 190 and the first chain 180 is connected at a distal end thereof to a side of the door panel 202 as shown in FIG. 25. Subsequently, the air ON/OFF switch 220 is operated to retract the piston 81 into the cylinder, to thereby draw out the recess 251, leading to correction of the recess 251. The sheet metal correcting equipment 1 is transferred from a state shown in FIG. 25 to that of FIG. 26.

As can be seen form the foregoing, the automobile sheet metal correcting equipment of the present invention exhibits many advantages.

More particularly, the automobile sheet metal surface correcting equipment of the present invention facilitates satisfactory sheet metal working because of solely selectively carrying out pushing and pulling of a sheet metal surface depending on properties of the sheet metal surface.

Also, the automobile sheet metal surface correcting equipment of the present invention satisfactorily prevents contamination of an automobile during sheet metal working.

Another advantage of the present invention is that correction of a site or portion of a sheet metal surface to be corrected is facilitated even when the portion requires that alignment between the piston and the portion of the surface is carried out from an inside of the sheet metal as seen in a bonnet, a trunk room or the like, because the air hose for connecting the compressed air feed means and the sheet metal surface correcting equipment to each other therethrough can be separated from the latter in the course of advancing or retracting of the piston.

Further, the automobile sheet metal surface correcting equipment of the present invention permits only one worker to rapidly carry out both operation of positioning the distal end of the piston on a portion of a sheet metal surface to be corrected and operation of advancing or retracting the piston, because the piston mechanism is actuated by merely operating the switch lever.

In addition, the automobile sheet metal surface correcting equipment of the present invention is so constructed that the holding bolts connect the covering means to both open ends of the housing to close the ends. Such construction permits the equipment to adequately withstand a load during sheet metal drawing operation which is apt to readily cause a load to be applied to a housing of the equipment. Also, it permits the automobile sheet metal surface correcting equipment to be portable.

Moreover, the automobile sheet metal surface correcting equipment of the present invention facilitates sheet metal operation or working because advancing or retracting the piston can be carried out by one-tough operation.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An automobile sheet metal surface correcting equipment comprising:

a housing having an air flow path means switchably arranged therein;

an air introduction means provided therein with air introduction passages for introducing compressed air into said housing therethrough;

an impact wrench mechanism arranged in said housing and actuated by means of compressed air fed through said air introduction means into said housing;

a screw bolt having rotating force applied thereto from said impact wrench mechanism; and a piston mechanism including a cylinder and a piston movably arranged in said cylinder in a retractable manner in association with rotation of said screw bolt;

whereby said air flow path means in said housing is changed over to retractably move said piston of said piston mechanism, resulting in a metal sheet surface being corrected.

2. An automobile sheet metal surface correcting equipment as defined in claim 1, wherein said housing includes a first receiving portion and a second receiving portion;

said first receiving portion having said impact wrench mechanism received therein;

said screw bolt includes a bolt head;

said second receiving portion having said bolt head of said screw bolt received therein; and said housing has a first opening formed on one of said end surfaces thereof and a second opening formed on the other of said end surfaces thereof;

said first opening being closed with a first cover means and said second opening being closed with a second cover means.

3. An automobile sheet metal surface correcting equipment, comprising:

a housing having an air flow path means switchably arranged therein;

an air introduction means provided therein with air introduction passages for introducing compressed air into said housing therethrough;

an impact wrench mechanism arranged in said housing and including an air motor actuated by means of compressed air fed into said housing and an impact wrench actuated by said air motor;

a screw bolt having rotating force applied thereto from said impact wrench mechanism;

a piston mechanism including a cylinder and a piston movably arranged in said cylinder in a retractable manner in association with rotation of said screw bolt; and a rotation direction changing-over valve for changing over said air flow path means, to thereby change over a direction of rotation of said air motor of said impact wrench mechanism;

said air flow path means including a first air flow path and a second air flow path which are changed over by said rotation direction changing-over valve;

whereby a direction of rotation of said air motor is changed over to actuate said piston of said piston mechanism, to thereby correct a sheet metal surface.

4. An automobile sheet metal surface correcting equipment, comprising:

a housing having an air flow path means switchably arranged therein;

an air introduction means provided therein with air introduction passages for introducing compressed air into said housing therethrough;

an impact wrench mechanism arranged in said housing and actuated by means of compressed air fed through said air introduction means into said housing;

a screw bolt having rotating force applied thereto from said impact wrench mechanism; and a piston mechanism including a cylinder and a piston movably arranged in said cylinder in a retractable manner in association with rotation of said screw bolt; and holding bolts arranged for mounting a cover means on each of end surfaces of said housing to close said end surface;

whereby said air flow path means in said housing is changed over during actuation of said impact wrench mechanism to actuate said piston of said piston mechanism, resulting in correcting a sheet metal surface.

5. An automobile sheet metal surface correcting equipment, comprising:

a housing having an air flow path means switchably arranged therein;

an air introduction means provided therein with air introduction passages for introducing compressed air into said housing therethrough;

an impact wrench mechanism arranged in said housing and including an air motor actuated by means of compressed air fed into said housing and an impact wrench actuated by said air motor;

a screw bolt having rotating force applied thereto from said impact wrench mechanism;

a piston mechanism including a cylinder and a piston movably arranged in said cylinder in a retractable manner in association with rotation of said screw bolt;

a rotation direction changing-over valve for changing over said air flow path means, to thereby change over a direction of rotation of said air motor of said impact wrench mechanism; and holding bolts for mounting a cover means on each of end surfaces of said housing to close said end surface;

said air flow path means including a first air flow path and a second air flow path which are changed over by said rotation direction changing-over valve;

whereby a direction of rotation of said air motor is changed over to actuate said piston of said piston mechanism, to thereby correct a sheet metal surface.

6. An automobile sheet metal surface correcting equipment comprising:

a housing having an air flow path mean switchably arranged therein;

an air introduction means provided therein with air introduction passages for introducing compressed air into said housing therethrough;

an impact wrench mechanism arranged in said housing and actuated by means of compressed air fed through said air introduction means into said housing;

a screw bolt having rotating force applied thereto from said impact wrench mechanism; and a piston mechanism including a cylinder and a piston movably arranged in said cylinder in a retractable manner in association with rotation of said screw bolt;

whereby said air flow path means in said housing is changed over to retractably move said piston of said piston mechanism, resulting in a metal sheet surface being corrected; and wherein said housing includes a first receiving portion and a second receiving portion;

said first receiving portion having said impact wrench mechanism received therein;

said screw bolt includes a bolt head;

said second receiving portion having said bolt head of said screw bolt received therein;

said housing has a first opening formed on one of said end surfaces thereof and a second opening formed on the other of said end surfaces thereof;

said first opening being closed with a first cover means and said second opening being closed with a second cover means;

wherein said housing has a cylindrical hole formed above said first receiving portion to fit a bushing therein;

said bushing being formed at a lower portion thereof on a rear right side thereof with a first air outlet hole and at a lower portion thereof on a front left side thereof with a second air outlet hole;

said housing has two air passages formed on both sides of said cylindrical hole;

one of said air passages being arranged so as to communicate with one air passage of said first cover means and said first air outlet hole of said bushing;

the other of said air passage being arranged so as to communicate with the other air passage of said first cover means and said second air outlet hole of said bushing.

7. An automobile sheet metal surface correcting equipment as defined in claim 6, wherein said impact wrench mechanism includes an air motor actuated by means of compressed air fed into said housing and an impact wrench actuated by said air motor;

a rotation direction changing-over valve is arranged for changing over said air flow path means, to thereby change over a direction of rotation of said air motor of said impact wrench mechanism; and said air flow path means includes a first air flow path and a second air flow path which are changed over said rotation direction changing-over valve;

whereby a direction of rotation of said air motor is changed over to actuate said piston of said piston mechanism, to thereby correct the sheet metal surface.

8. An automobile sheet metal surface correcting equipment as defined in claim 6, wherein holding bolts are arranged for mounting a cover means on each of end surfaces of said housing to close said end surface;

whereby said air flow path means in said housing is changed over during actuation of said impact wrench mechanism to actuate said piston of said piston mechanism, resulting in correcting the sheet metal surface.

9. An automobile sheet metal surface correcting equipment as defined in claim 7, wherein holding bolts are arranged for mounting a cover means on each of end surfaces of said housing to close said end surface;

whereby a direction of rotation of said air motor is changed over to actuate said piston of said piston mechanism, to thereby correct the sheet metal surface.

10. An automobile sheet metal surface correcting equipment as defined in claim 6, wherein said air introduction means includes a handle having said air introduction passages formed therein;

said handle being arranged above said housing.

11. An automobile sheet metal surface correcting equipment as defined in claim 6, wherein said first cover means is formed on an inner surface thereof with a pair of air passages constituting a part of said air flow path means.

12. An automobile sheet metal surface correcting equipment as defined in claim 6, wherein said housing has a step formed on an upper surface thereof; and said air introduction means includes a handle formed with said air introduction passage;

said step of said housing being formed with an air introduction hole so as to communicate with said air introduction passage of said handle.

13. An automobile sheet metal surface correcting equipment as defined in claim 6, wherein said step of said housing is formed at corners thereof with threaded holes; and said handle is airtightly fixed at a proximal end thereof on said step of said housing by means of bolts.

14. An automobile sheet metal surface correcting equipment as defined in claim 6, wherein said air introduction means includes a handle, an air regulator arranged on a proximal end of said handle, an air valve arranged on a central portion of a bottom surface of said handle, a switch lever disposed so as to operate said air valve, a control pin for selectively controlling movement of said switch lever, and a stopper pivotally supported in a cutout formed at a free end of said switch lever so as to be raised therein;

said air valve being rendered open by operating said switch lever toward said bottom surface of said handle;

control of movement of said switch lever by said control pin being carried out in order to maintain such an open state of said air valve.

15. An automobile sheet metal surface correcting equipment as defined in claim 14, wherein said air valve includes a valve body;

said valve body being disposed in a valve chest arranged between said air introduction passages;

said valve body of said air valve, when said switch lever is operated to upwardly push a lower end of said air valve while abuttedly contacting it with an upper surface of said switch lever, being raised from a valve seat arranged in said valve chest, resulting in said air valve being rendered open, so that said air introduction passages may be permitted to communicate with each other, to thereby permit compressed air introduced to flow into said housing through said air introduction hole formed on said upper surface of said housing.

16. An automobile sheet metal surface correcting equipment as defined in claim 6, wherein said rotation direction changing-over valve is projected at both ends thereof from said bushing.

17. An automobile sheet metal surface correcting equipment as defined in claim 6, wherein said piston mechanism includes said piston, said cylinder and a piston guide member;

said piston being constructed into a hollow structure, resulting in being provided therein with a central hole so as to extend in a longitudinal direction thereof;

said central hole of said piston being formed with female threads with which male threads of said screw bolt are threadedly engaged;

said piston being formed on an outer peripheral surface thereof with an elongated guide groove for guiding said piston guide member;

said guide groove being arranged so as to extend in the longitudinal direction of said piston.

18. An automobile sheet metal surface correcting equipment as defined in claim 8, wherein said first cover means, housing and second cover means are integrally connected to each other by means of said holding bolts inserted through corners of said housing;

said holding bolts each being threadedly engaged at a distal end thereof with each of the female screws formed in said second cover member.

* * * * *